US005243252A

United States Patent [19]

Kaneko et al.

[11] Patent Number: 5,243,252

[45] Date of Patent: Sep. 7, 1993

[54] ELECTRON FIELD EMISSION DEVICE

[75] Inventors: Akira Kaneko, Tokyo; Toru Kanno, Kawasaki; Kaoru Tomii, Isehara, all of Japan

[73] Assignee: Matsushita Electric Industrial Co., Ltd., Osaka, Japan

[21] Appl. No.: 629,954

[22] Filed: Dec. 19, 1990

[30] Foreign Application Priority Data

| | | | |
|---|---|---|---|
| Dec. 19, 1989 | [JP] | Japan | 1-330740 |
| Apr. 11, 1990 | [JP] | Japan | 2-95803 |
| May 16, 1990 | [JP] | Japan | 2-127242 |
| May 23, 1990 | [JP] | Japan | 2-133397 |
| Jul. 5, 1990 | [JP] | Japan | 2-177727 |

[51] Int. Cl.[5] ..... H01J 1/02

[52] U.S. Cl. ..... 313/309; 313/351; 313/336

[58] Field of Search ..... 313/309, 310, 422, 352, 313/351, 336

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 315/309 |
| 4,168,213 | 9/1979 | Hoeberechts | 205/122 |
| 4,578,614 | 3/1986 | Gray et al. | 313/309 |
| 4,728,851 | 3/1988 | Lambe | 313/336 |
| 4,828,177 | 5/1989 | Lee et al. | 313/336 |

FOREIGN PATENT DOCUMENTS

| | | | |
|---|---|---|---|
| 290026 | 11/1988 | European Pat. Off. . | |
| 400406 | 12/1990 | European Pat. Off. . | |
| 51-54358 | 5/1976 | Japan . | |
| 0121454 | 10/1978 | Japan | 313/309 |
| 54-17551 | 6/1979 | Japan . | |
| 63-207027 | 8/1988 | Japan . | |
| 8909479 | 10/1989 | World Int. Prop. O. . | |

OTHER PUBLICATIONS

"A Thin-Film Field-Emission Cathode", by C.A. Spindt, *Journal of Applied Physics*, vol. 39, No. 7, pp. 3504 and 3505, Feb., 1956.

*Primary Examiner*—Donald J. Yusko
*Assistant Examiner*—N. D. Patel
*Attorney, Agent, or Firm*—Lowe, Price, LeBlanc & Becker

[57] ABSTRACT

An electron emission device is employed as an electron emission source in various applications using an electron beam. The electron emission device has a cathode layer having an edge, and a control electrode spaced and electrically insulated from the cathode layer, for drawing electrons from said edge of the cathode layer. When a voltage is applied between the cathode layer and the control electrode, a developed electric field is concentrated on the edge of the cathode layer to cause the edge to emit electrons. The electron emission device can easily be manufactured with a high yield since it does not have a needle tip for emitting electrons. A method of manufacturing the electron emission device is also disclosed.

16 Claims, 22 Drawing Sheets

ELECTRON FIELD EMISSION DEVICE

BACKGROUND OF THE INVENTION

1. Field of the Invention

The present invention relates to an electron emission device for use as a source for electrons in an electron microscope, an electron beam exposure apparatus, a planar image display, or any of various other applications using an electron beam, and a method of manufacturing such an electron emission device.

2. Prior Art

Hot cathodes for emitting electrons by thermionic emission are used as the source for electrons in various electron beam devices such as an electron microscope, an electron beam exposure apparatus, or a planar image display. The hot cathode requires a heater for heating the cathode itself, and hence causes a loss of energy because of the heating of the cathode.

Recent years have seen the advent of an electron emitter, known as a cold cathode, which does not depend on heat for electron emission. There have been proposed various electron emission devices incorporating the cold cathode. According to one electron emission device, a PN junction is reverse-biased to bring about an electron avalanche breakdown for electron emission Another electron emission device is of the MIM type which has a three-layer structure composed of a metal layer, an insulation layer, and a metal layer. When a voltage is applied between the metal layers, electrons are forced to pass through the insulation layer due to the tunnel effect, and emitted out of a metal layer surface. Still another electron emission device, which operates on the principle of field emission, has a specially shaped metal surface to which a voltage is applied to develop a localized highly intensive electric field which emits electrons out of the metal surface.

One field-emission-type electron emission device has a cathode emitter whose end is machined into a sharply pointed needle tip having a curvature of several hundreds nm or smaller so that a concentrated electric field of about $10^7$ V/cm will be developed at the pointed needle tip. The field-emission-type electron emission device of this type offers the following advantages:

(1) It has a high current density.

(2) Any consumption of electric energy is very small as the cathode emitter requires no heating.

(3) The device can be used as point and linear sources for electron beams.

A field emission-type electron emission device is shown in Journal of Applied Physics, Vol. 39, No. 7, Page 3504, 1956, for example. FIG. 1(*a*) of the accompanying drawings shows such a known field-emission-type electron emission device in the process of being manufactured. FIG. 1(*b*) illustrates the field-emission-type electron emission device as it is completed.

The field-emission-type electron emission device is manufactured as follows: As shown in FIG. 1(*a*), an electrically conductive film 102, an electrically insulative layer 103, and an electrically conductive film 104 are successively evaporated on an electrically insulative substrate 101. The conductive film 104 and the insulative layer 103 are selectively etched away to produce an array of cavities 105 therein according to a photolithographic process. Thereafter, while the open ends of the cavities 105 are being progressively closed by a suitable material 106 according to the rotary slant evaporation process, a cathode material 107 is evaporated on the conductive film 102 through the open ends of the cavities 105, thereby forming upwardly pointed cathode emitter projections 108 on the conductive film 102 within the cavities 105. Thereafter, the evaporated material 106 is removed, completing the electron emission device as shown in FIG. 1(*b*).

A power supply 109 is connected to the conductive films 104, 102 such that the conductive film 104 is kept at a positive potential and the conductive film 102 is kept at a negative potential. When a voltage higher than a predetermined voltage that is determined by the cathode material 107 is applied between the conductive films 104, 102, a concentrated electric field is developed which causes the cathode emitter projections 108 to emit electrons.

An effort has been directed to a planar display which comprises an array of such electron emission devices (see Japan Display, 1986, page 512).

Japanese Patent Publication No. 54(1979)-17551 discloses another conventional electron emission device. FIGS. 2(*a*) through 2(*f*) of the accompanying drawings show a process of successive steps for manufacturing such a conventional electron emission device.

First, as shown in FIG. 2(*a*), a thin film 122 of a cathode material is evaporated on one surface of each of a plurality of rectangular, electrically insulative substrates 121, thus producing a plurality of substrates 123. Then, the substrates 123 are superposed to provide a unitary substrate 124, after which the surfaces of the substrate 124 are machine ground. Then, as shown in FIG. 2(*b*), a metal film 125 is evaporated on one of the wider surfaces of the substrate 124. Electron emission windows 126, which are as narrow as the thin films 122, are defined in the metal film 125 directly over the respective thin films 122 by a photoetching process, as shown in FIG. 2(*c*). Then, the substrates 123 are separated from each other, and the thin film 122 of each substrate 123 is etched into a cathode emitter 127 having a pointed triangular pattern, as shown in FIG. 2(*d*). Thereafter, as shown in FIG. 2(*e*), each substrate 121 is partially chemically eroded away to produce a cavity 128 such that the pointed ends of the cathode emitter 127 are spaced from the substrate 121 and the edge of the metal film 125 along the electron emission window 126 overhangs. As shown in FIG. 2(*f*), the substrates 123 are superposed again and fixed together, thus producing a thin-film cold-cathode array.

The production of the electron emission device shown in FIGS. 1(*a*) and 1(*b*) is disadvantageous in that it is very difficult to control the two simultaneous evaporation processes, i.e., for depositing the material 106 and the cathode emitter projections 108 simultaneously.

With the electron emission device shown in FIGS. 2(*a*) through 2(*f*), the thicknesses of the insulative substrates 121 and the thin films 122 must be highly accurate in order to position the electron emission windows 126 and the cathode emitters 127 in accurate alignment with each other. Furthermore, difficulty has been experienced in fixing the substrates 123 with the same degree of accuracy when they are first assembled into the substrate 124 and subsequently put together into the final product.

SUMMARY OF THE INVENTION

It is an object of the present invention to provide an electron emission device which is simple in construction, can be manufactured easily with a high yield, and is highly reliable in operation, and a method of manufacturing such an electron emission device.

Another object of the present invention is to provide an electron emission device which is capable of emitting a highly defined high-quality electron beam, and a method of manufacturing such an electron emission device.

Still another object of the present invention is to provide an electron emission device which can emit electrons highly efficiently, and a method of manufacturing such an electron emission device.

According to the present invention, there is provided an electron emission device comprising a cathode layer having an edge, and a control electrode spaced and electrically insulated from the cathode layer, for drawing electrons from the edge of the cathode layer.

The electron emission device further includes an insulative substrate, the cathode layer having at least a portion of a rectangular shape, and being disposed on the insulative substrate, and an insulative layer disposed on the insulative substrate on each or one side of the cathode layer, the control electrode being disposed on the insulative layer. The insulative layer is as thick as or thicker than the cathode layer.

The electron emission device also includes a plurality of parallel cathode layers spaced at a predetermined pitch, and a plurality of parallel control electrodes spaced at a predetermined pitch and extending perpendicularly to the cathode layers. The cathode layers and the control electrodes jointly provide a plurality of electron emission areas where the cathode layers and the control electrodes intersect with each other, each of the electron emission regions being of a zigzag shape.

Alternatively, the electron emission device further includes an insulative substrate, the cathode layer being disposed on the insulative substrate, and an insulative layer disposed on the insulative substrate inwardly of the cathode layer, the control electrode being disposed on the insulative layer.

The electron emission device further includes a conductive layer extending through the insulative layer and electrically connected to the control electrode on the insulative layer. The control electrode has a bottom surface as high as or higher than a surface of the cathode layer remote from the insulative substrate.

Alternatively, the electron emission device further has an insulative substrate, the cathode layer being disposed on the insulative substrate, the control electrode comprising first and second control electrodes, a first insulative layer disposed on the cathode layer, the first control electrode being disposed on the first insulative layer, and a second insulative layer disposed on the insulative substrate, the second control electrode being disposed on the second insulative layer outwardly of the cathode layer, the first insulative layer, and the first control electrode, the first and second control electrodes being electrically connected to each other.

The electron emission device also includes a third insulative layer disposed on portions of the cathode layer and the insulative substrate, and an electric connector disposed on the third insulative layer, the first and second control electrodes being electrically connected to each other by the electric connector.

Alternatively, the electron emission device further includes a third insulative layer disposed on the insulative substrate, and an electric connector extending through the cathode layer, the first insulative layer, the third insulative layer, and the second insulative layer, the first and second control electrodes being electrically connected to each other by the electric connector.

The electron emission device further includes a fourth insulative layer disposed on the second control electrode, and a third control electrode disposed on the fourth insulative layer.

Alternatively, the electron emission device further includes an insulative substrate, the cathode layer having a wedge-shaped portion having a progressively varying width, and an insulative layer disposed on the insulative substrate outwardly of cathode layer, the control electrode being disposed on the insulative layer.

The electron emission device further includes a base electrode disposed on the insulative substrate, the cathode layer being disposed on the base electrode. The electron emission device also has a second insulative layer disposed on at least a surface of the base electrode which is free from the cathode layer, the first-mentioned insulative layer being disposed on the second insulative layer. The first-mentioned insulative layer is as thick as or thicker than the cathode layer.

The electron emission device includes a plurality of parallel striped base electrodes spaced at a predetermined pitch, and a plurality of parallel control electrodes spaced at a predetermined pitch and extending perpendicularly to the base electrodes, whereby the base and control electrodes jointly provide a matrix construction.

According to the present invention, there is also provided a method of manufacturing an electron emission device, comprising the steps of depositing a cathode layer having an edge on an insulative substrate, depositing a material, different from the material of the cathode layer, on the cathode layer, thereafter successively depositing an insulative layer and a metal film on the insulative substrate and the deposited material, removing the deposited material, together with the insulative layer and the metal film thereon, from the cathode layer, and etching the insulative material and the metal film to form a control electrode, which is composed of the etched metal film, on the insulative material on each or one side of the cathode layer.

According to the present invention, there is also provided a method of manufacturing an electron emission device, comprising the steps of depositing a cathode layer having an edge on an insulative substrate, depositing a metal material, different from the material of the cathode layer, all over the cathode layer by plating, thereafter successively depositing an insulative layer and a metal film on the insulative substrate and the metal material, and removing the metal material, together with the insulative layer and the metal film thereon, from the cathode layer to form a control electrode, which is composed of the metal film, on the insulative material on each or one side of the cathode layer.

According to the present invention, there is further provided a method of manufacturing an electron emission device, comprising the steps of depositing a base electrode on an insulative substrate, successively depositing a cathode layer and a covering layer of a material, which is different from the material of the cathode layer, on the base electrode, etching the covering layer and the cathode layer into a wedge shape having a gradually varying width, processing at least a surface of the base electrode, which is free from the cathode layer, into a first insulative layer by anodization or thermal oxidization, successively depositing a second insulative layer and a control electrode on the first insulative layer and the covering layer, and thereafter, removing the covering layer with the second insulative layer and the control electrode thereon. The method further includes the step of etching the cathode layer into a pattern smaller than the covering layer.

According to the present invention, there is also provided a method of manufacturing an electron emission device, comprising the steps of depositing a base electrode on an insulative substrate, depositing a first insulative layer on the base electrode, the first insulative layer having the same pattern as a cathode layer having a wedge shape having a gradually varying width, processing at least a surface of the base electrode, which is free from the first insulative layer, into a second insulative layer by anodization or thermal oxidization, removing the first insulative layer, successively depositing a cathode layer and a covering layer, which is different from the material of the cathode layer, on the base electrode, etching the covering layer and the cathode layer in one pattern at substantially the same position as the removed first insulative layer, depositing a third insulative layer and a control electrode on the first insulative layer and the covering layer, and thereafter removing the covering layer with the third insulative layer and the control electrode thereon. The third insulative layer is disposed outwardly of the cathode layer and is as thick as or thicker than the cathode layer. The method also includes the step of etching the cathode layer into a pattern smaller than the covering layer, and also the step of insulating the base electrode except an area thereof which is as large as or smaller than the pattern of the cathode layer.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 1(*b*) is a cross-sectional view of the conventional electron emission device as it is completed;

FIG. 17(*b*) is a cross-sectional view taken along line 17(*b*)—17(*b*) of FIG. 17(*a*);

FIG. 17(*c*) is a cross-sectional view taken along line 17(*c*)—17(*c*) of FIG. 17(*a*);

FIG. 18(*b*) is a cross-sectional view taken along line 18(*b*)—18(*b*) of FIG. 18(*a*);

FIG. 21(*b*) is a cross-sectional view taken along line 21(*b*)—21(*b*) of FIG. 21(*a*);

FIG. 21(*c*) is a cross-sectional view taken along line 21(*c*)—21(*c*) of FIG. 21(*a*);

FIG. 24(*b*) is a cross-sectional view taken along line 24(*b*)—24(*b*) of FIG. 24(*a*).

DETAILED DESCRIPTION OF THE PREFERRED EMBODIMENTS

Figure 1A:
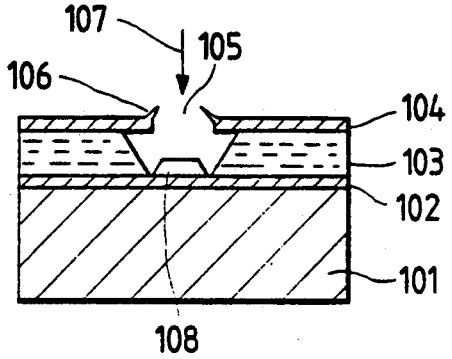
FIG. 1(a) PRIOR ART
FIG. 1(*a*) is a cross-sectional view of a conventional electron emission device as it is in the process of being manufactured;.

Like or corresponding parts are denoted by like or corresponding reference numerals throughout views.

Figure 3A:
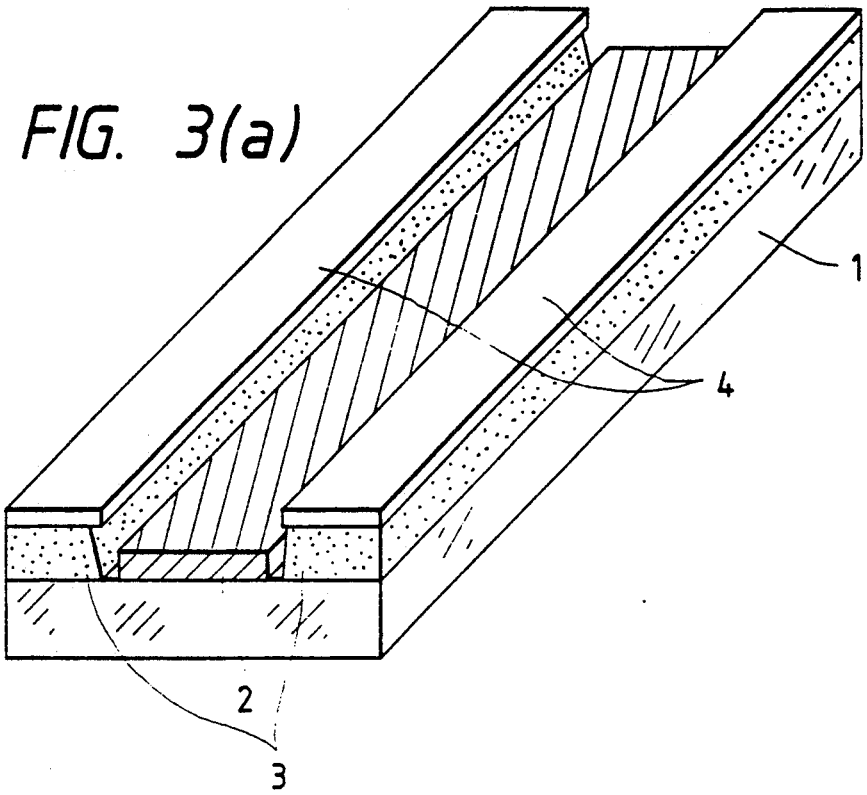
FIGS. 3(*a*) and 3(*b*) are perspective and cross-sectional views, respectively, of an electron emission device according to a first embodiment of the present invention.
Figure 3B:
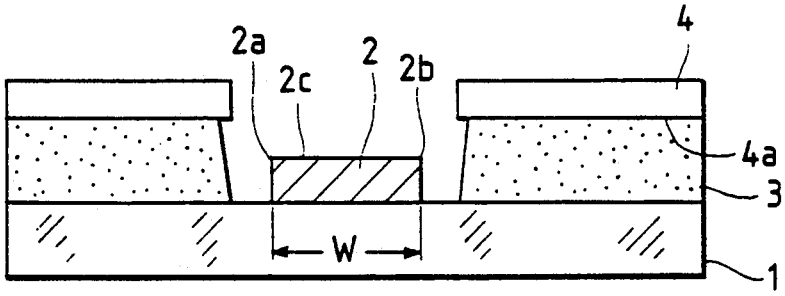
Figure 4A:
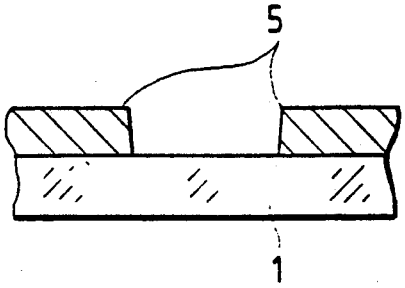
FIGS. 4(*a*) through 4(*h*) are fragmentary cross-sectional views showing a process of manufacturing the electron emission device according to the first embodiment.
Figure 4B:
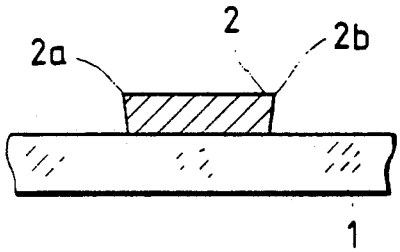
Figure 4C:
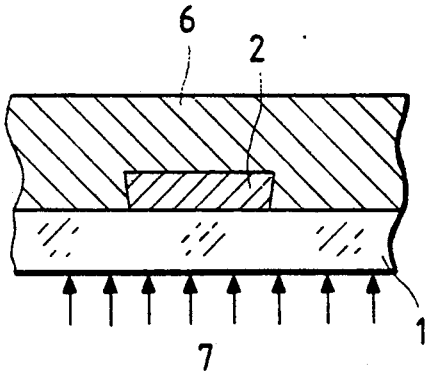
Figure 4D:
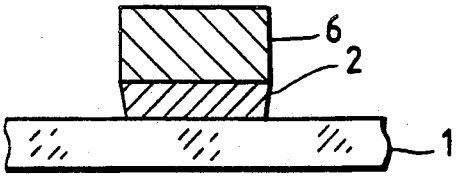
Figure 4E:
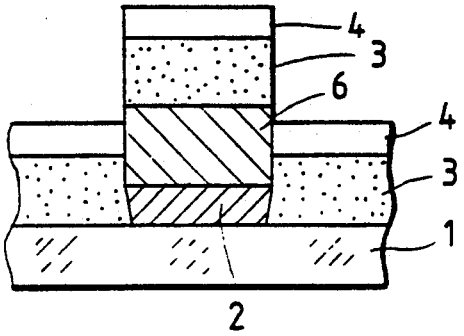
Figure 4F:
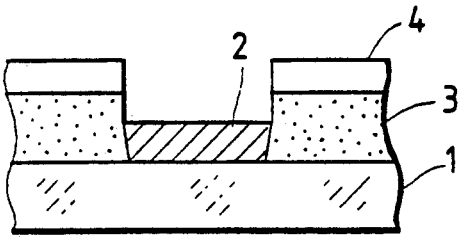
Figure 4G:
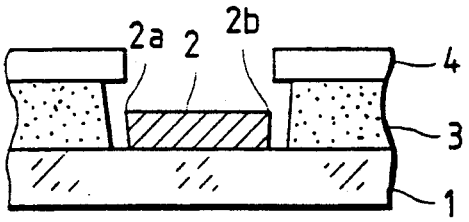
Figure 4H:
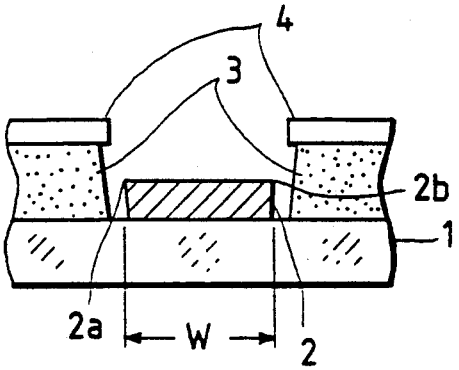
Figure 5A:
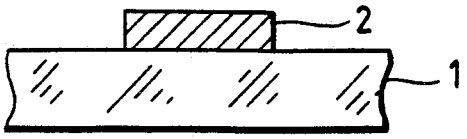
FIGS. 5(*a*) through 5(*e*) are fragmentary cross-sectional views showing another process of manufacturing the electron emission device according to the first embodiment.
Figure 5B:
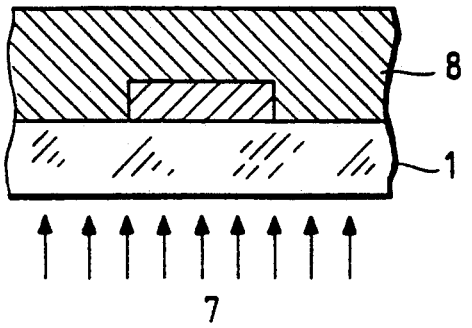
Figure 5C:
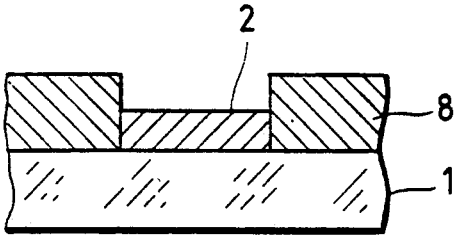
Figure 5D:
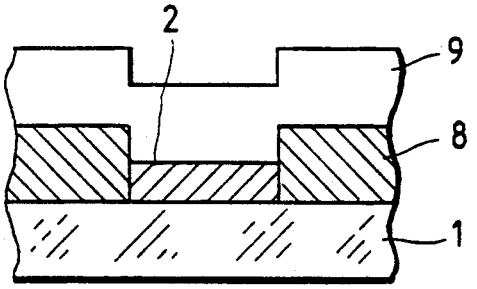
Figure 5E:
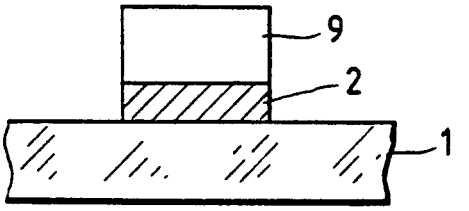
Figure 6A:
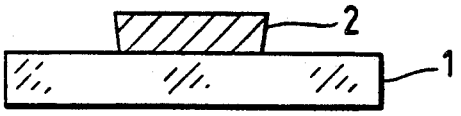
FIGS. 6(*a*) through 6(*d*) are fragmentary cross-sectional views showing still another process of manufacturing the electron emission device according to the first embodiment.
Figure 6B:
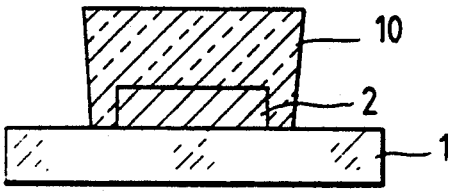
Figure 6C:
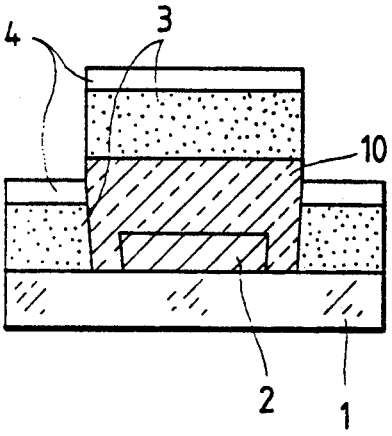
Figure 6D:
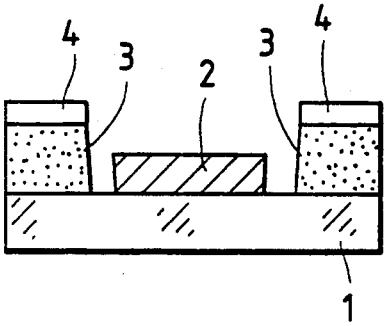

FIGS. 3(*a*) and 3(*b*) show an electron emission device in accordance with a first embodiment of the present invention.

As shown in FIGS. 3(*a*) and 3(*b*), a layer 2 of a cathode material is disposed on an electrically insulative substrate 1 of glass or the like. The cathode material of the layer 2 comprises a material having a low work function and a high melting point, such as SiC, ZrC, TiC, Mo, W, or the like. The layer 2 has a thickness of 1000 Å or more and has a rectangular cross section. The layer 2 has opposite edges 2*a*, 2*b* on its upper surface. The width W of the layer 2 is determined depending on the manner in which the electron emission device is used, and should not be limited to any particular dimension. Two electrically insulative layers 3 are disposed on the insulative substrate 1 one on each side of the layer 2 in spaced relation thereto. Each of the insulative layers 3 is made of $Al_2O_3$, $SiO_2$, or the like, and has a thickness which is at least the same as the thickness of the layer 2. Only one insulative layer 3 may be disposed on one side of the layer 2 on the insulative substrate 1. On the insulative layers 3, there are disposed respective control electrode 4 for drawing electrons from the edges 2*a*, 2*b* of the cathode layer 2. Each of the control electrodes 4 comprises a metal film of Mo, Ta, W, or the like. Since the thickness of the insulative layers 3 is the same as or greater than the thickness of the layer 2, the bottom surfaces 4*a* of the control electrodes 4 are located at a height that is the same as or higher than the height of the upper surface 2*c* of the layer 2.

The electron emission device shown in FIGS. 3(*a*) and 3(*b*) operates as follows:

The layer 2 and the control electrodes 4 are connected to a power supply (not shown) such that the layer 2 is held at a positive potential and the control electrodes 4 at a negative potential. When a voltage higher than a predetermined voltage depending on the cathode material of the layer 2 is applied between the layer 2 and the control electrodes 4, a developed electric field is concentrated on edges 2*a*, 2*b* of the layer 2 to cause the edges 2*a*, 2*b* to emit electrons into a surrounding evacuated space. The emitted electrons travel along electric lines of force that are determined under the applied voltage between the control electrodes 4 and the layer 2. Some of the electrons enter the control electrodes 4, while the other electrons fly upwardly of the control electrodes 4. Inasmuch as the bottom surfaces 4*a* of the control electrodes 4 are as high as or higher than the upper surface 2*c* of the layer 2, the electrons emitted from the edges 2*a*, 2*b* travel at a velocity whose upward component is large. Therefore, the number of electrons flying over or upwardly of the control electrodes 4, i.e., the intensity of the electron beams from the edges 2*a*, 2*b*, is increased. Since the edges 2*a*, 2*b* of the layer 2 are disposed in confronting relation to the control electrodes 4, respectively, the electric field produced between the control electrodes 4 and the cathode layer 2 is concentrated on the edges 2*a*, 2*b*, thus increasing the effective field strength at the edges 2*a*, 2*b* for electron emission, with the advantage that the voltage applied to emit electrons may be reduced.

A process of manufacturing the electron emission device shown in FIGS. 3(*a*) and 3(*b*) will be described below with reference to FIGS. 4(*a*) through 4(*h*).

First, as shown in FIG. 4(*a*), a photoresist 5 is deposited on the surface of a transparent, electrically insulative substrate 1 of glass or the like, except an area where a layer 2 of cathode material is to be deposited. Then, a cathode material is deposited on the substrate 1 and the photoresist 5 to a thickness of 1000 Å or more by vacuum evaporation, sputtering, or the like, after which the photoresist 5 is removed. Thus, the layer 2 of cathode material is now formed on the substrate 2 in a pattern shown in FIG. 4(*b*). The above liftoff method which is used to deposit the layer 2 on the substrate 1 allows the layer 2 to have sharp edges 2*a*, 2*b* on its opposite sides for a higher electron emission efficiency. Alternatively, after a cathode material has been deposited on the surface of the substrate 1, the deposited cathode material may be selectively etched away to leave a layer 2 on the substrate 1 in the pattern shown in FIG. 4(*b*). Thereafter, as shown in FIG. 4(*c*), a positive photoresist 6 is coated on the substrate 1 and the layer 2, and then exposed to a parallel beam 7 of ultraviolet radiation which is applied to the surface of the substrate 1 opposite to the layer 2. The exposed photoresist 6 is then developed by a developing solution into the same photoresist pattern as the layer 2, as shown in FIG. 4(*d*). As shown in FIG. 4(*e*), an electrically insulative material such as $Al_2O_3$, $SiO_2$, or the like, which will form electrically insulative layers 3, is deposited on the entire surface formed thus far to a thickness which is the same as or greater than the layer 2, by vacuum evaporation or the like. Then, a metal film, which will form control electrodes 4 for drawing electrons, is deposited on the insulative material to a thickness ranging from 1000 Å to 5000 Å. When the photoresist 6 is thereafter removed, the insulative material and the metal film over the layer 2 are also removed, as shown in FIG. 4(*f*). As shown in FIG. 4(*g*), only the insulative material is partly etched away, providing an insulative layer 3 spaced from the layer 2, which has exposed edges 2*a*, 2*b* as shown in FIG. 4(*h*). Then, the metal film is also partly etched away, providing control electrodes 4 which have confronting edges spaced from each other by a distance slightly larger than the width W of the layer 2. The insulative material and the metal layer may be simultaneously etched using a mixture of etching solutions respectively for the insulating material and the metal layer. If the photoresist 6 is developed in the step shown in FIG. 4(*d*) so that it is left so as to cover the layer 2 and have a width slightly greater than the width W of the layer 2, then the steps shown in FIGS. 4(*g*) and 4(*h*) may be dispensed with.

FIGS. 5(*a*) through 5(*e*) show another process of manufacturing the electron emission device shown in FIGS. 3(*a*) and 3(*b*).

The manufacturing steps of the process shown in FIGS. 5(*a*) through 5(*e*) correspond to the steps shown in FIGS. 4(*b*) through 4(*d*), but differ therefrom with respect to the steps shown in FIGS. 4(*c*) and 4(*d*). Those parts in FIGS. S(*a*) through S(*e*) which are identical to those in FIGS. 4(*b*) through 4(*d*) are denoted by identical reference numerals. The step shown in FIG. 5(*a*) is the same as the step shown in FIG. 4(*b*), in which a layer 2 of cathode material is deposited in a certain pattern on a transparent, electrically insulative substrate 1. Then, as shown in FIG. 5(*b*), a negative photoresist 8 is coated on the substrate 1 and the layer 2, and then exposed to a parallel beam 7 of ultraviolet radiation which is applied to the surface of the substrate 1 opposite to the layer 2. The exposed photoresist 6 is then developed by a developing solution, removing the photoresist layer from the surface of the layer 2, as shown in FIG. 5(*c*). Then, as shown in FIG. 5(*d*), a metal layer 9 of Ni, Cu, or the like is deposited on the surface formed thus far by electroless plating, or a metal layer 9 of Al or the like is deposited on the surface formed thus far by evaporation, sputtering, or the like. Thereafter, the photoresist 8 is removed together with the metal layer thereon, leaving the metal layer 9 only on the layer 2, as shown in FIG. 5(*e*). The assembly will then be processed in the same manner as the steps shown in FIGS. 4(*e*) through 4(*h*). The process shown in FIGS. 5(*a*) through 5(*e*) is suitable when a heat treatment, which involves temperatures higher than the photoresist 6 would resist, is to be carried out to achieve increased bonding strength between the insulative substrate 1 and the insulative layers 3 and also between the insulative layers 3 and the control electrodes 4 at the time the insulative layer 3 and the control electrode 4 are formed.

FIGS. 6(*a*) through 6(*d*) show still another process of manufacturing the electron emission device shown in FIGS. 3(*a*) and 3(*b*).

Those parts shown in FIGS. 6(*a*) through 6(*d*) which are identical to those in FIGS. 4(*a*) through 4(*h*) are denoted by identical reference numerals. First, as shown in FIG. 6(*a*), a layer 2 of cathode material is deposited in a certain pattern on a transparent, electrically insulative substrate 1. Then, as shown in FIG. 6(*b*), a metal 10 which is different from the cathode material is plated on the layer 2 and also an area of the substrate 1 surrounding the layer 2. Thereafter, as shown in FIG. 6(*c*), an electrically insulative material such as $Al_2O_3$, $SiO_2$, or the like, which will form insulative layers 3, is deposited on the entire surface formed thus far by vacuum evaporation, sputtering, or the like, and then a metal film, which will form control electrodes 4, is deposited on the insulative material. Thereafter, the plated metal 10 is etched away from the insulative substrate 1, thereby providing the electron emission device as shown in FIG. 6(*d*). The metal of the control electrodes 4 differs from the plated metal 10, so that the control electrodes 4 are not eroded when the metal 10 is etched away.

An electron emission device according to a second embodiment of the present invention, which is incorporated in a planar display panel, will now be described with reference to FIG. 7.

Figure 1B:
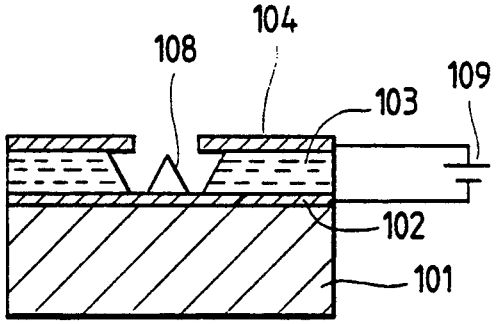
FIG. 1(b) PRIOR ART
Figure 2A:
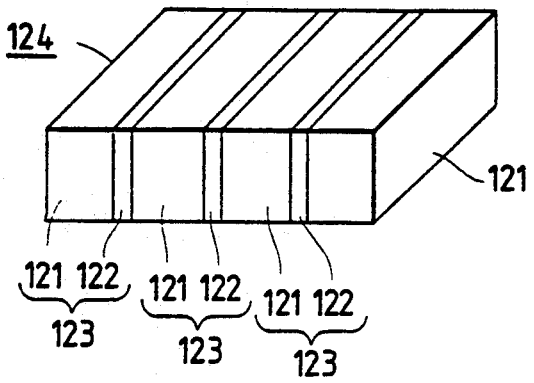
FIG. 2(a) PRIOR ART
FIGS. 2(*a*) through 2(*f*) are views showing a process of manufacturing another conventional electron emission device.
Figure 2D:
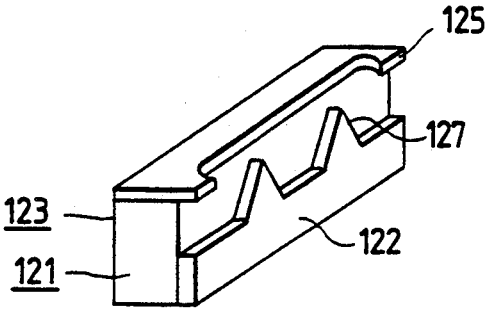
FIG. 2(d) PRIOR ART
Figure 2B:
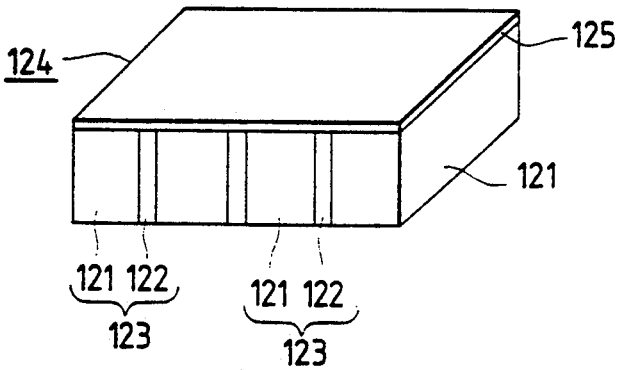
FIG. 2(b) PRIOR ART
Figure 2E:
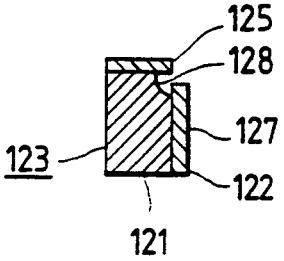
FIG. 2(e) PRIOR ART
Figure 2C:
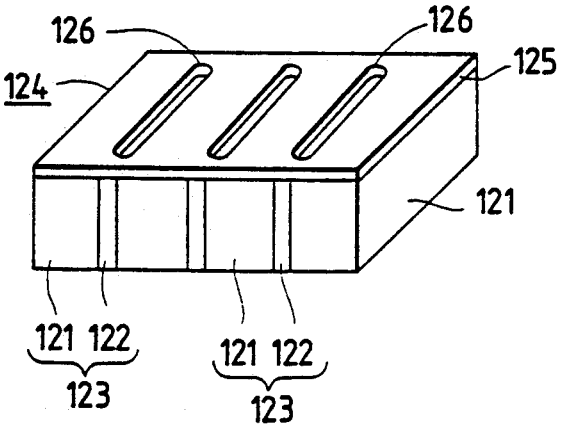
FIG. 2(c) PRIOR ART
Figure 2F:
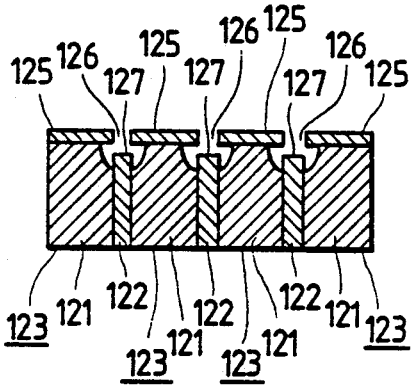
FIG. 2(f) PRIOR ART
Figure 7:
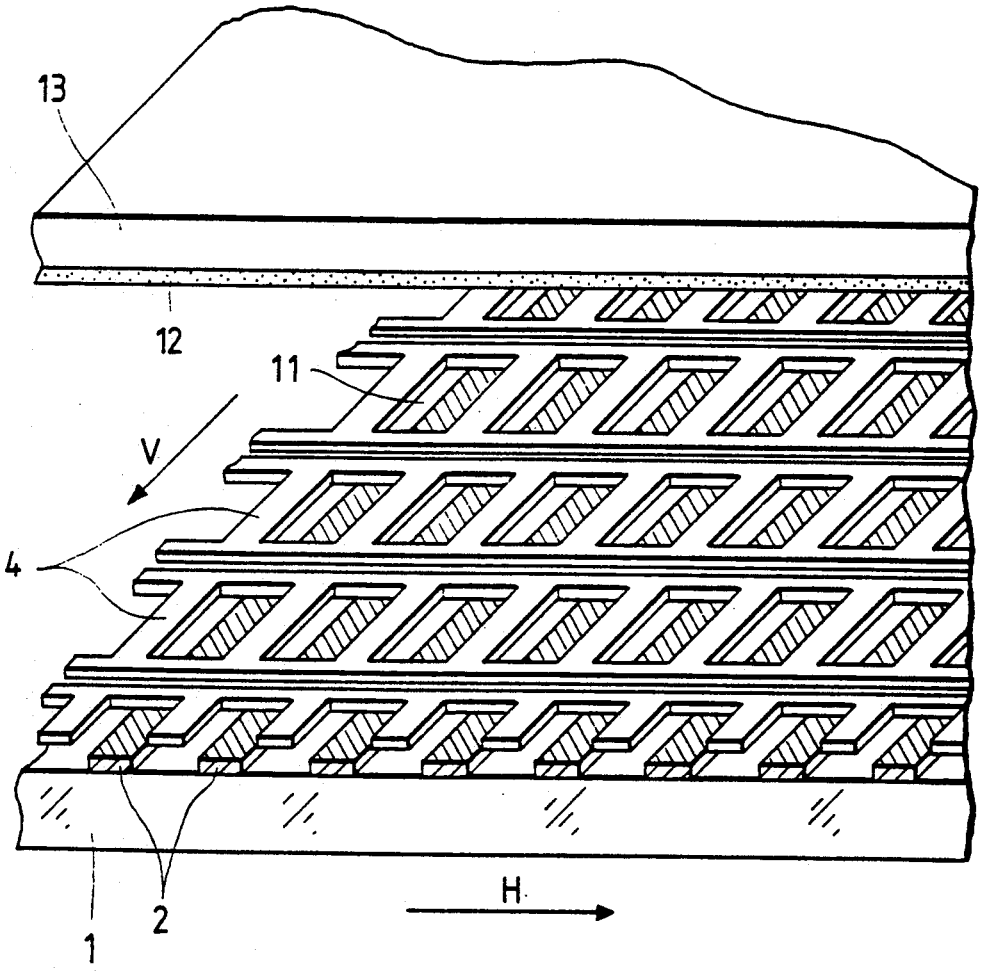
FIG. 7 is a fragmentary perspective view of an electron emission device according to a second embodiment of the present invention, the electron emission device being incorporated in a planar display panel.

As shown in FIG. 7, the electron emission device has a plurality of parallel elongate striped layers 2 of cathode material disposed on an electrically insulative substrate 1, the layers 2 extending in the vertical direction indicated by the arrow V and spaced at a predetermined pitch, and a plurality of parallel elongate striped control electrodes 4 extending over the layers 2 while crossing with an overpass at regular angles i.e., in the horizontal direction indicated by the arrow H. The control electrodes 4 have windows 11 defined therein for drawing electron beams from the layers 2 therethrough. The control electrodes 4 are spaced at a predetermined pitch and electrically separated from each other in the vertical direction. Underneath the control electrodes 4, there are disposed insulative layers which are the same as the insulative layer 3 shown in FIGS. 1(*a*) and 1(*b*), but are omitted from illustration in FIG. 7 for the sake of brevity. The electron emission device also includes a transparent substrate 13 of glass or the like which supports a light-emitting layer 12 of a fluorescent material on its surface facing the control electrodes 4. The transparent substrate 13 is spaced from the control electrodes 4. The layers 2 and the control electrodes 4 intersect with each other at a matrix of points each serving as a pixel.

Operation of the planar display panel shown in FIG. 7 is as follows: For the display of an image in a standard television system, the electron emission device has as many cathode layers 2 as the number of pixels in the horizontal direction and as many control electrodes 4 as the number of scanning lines effective to display the image. A given voltage is applied between a selected cathode layer 2 and a selected control electrode 4 to develop an electric field at the edges of the cathode layer 2 for thereby causing the cathode layer 2 to emit a beam of electrons. The electron beam is then applied to the light-emitting layer 12 which emits light. When the planar display panel is energized in the same manner as an X-Y-matrix plasma display or a liquid crystal display, the planar display panel can display an image produced by the fluorescent light-emitting layer 12 that glows under electron bombardment.

Figure 8:
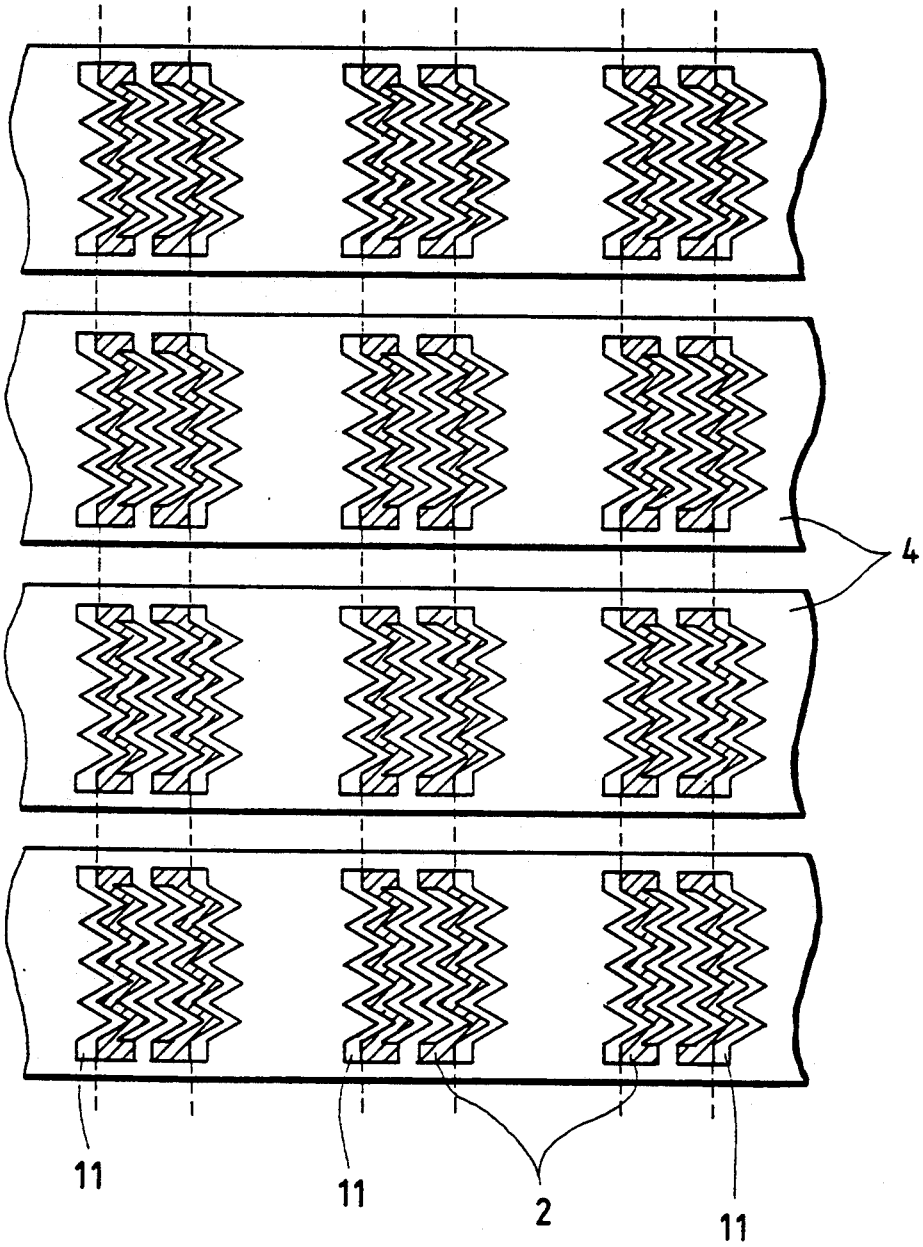
FIG. 8 is a fragmentary plan view of an electron emission device according to a third embodiment of the present invention, the electron emission device being incorporated in a matrix electron emission source.

FIG. 8 shows an electron emission device according to a third embodiment of the present invention, the electron emission device being incorporated in a matrix electron emission source or a planar display panel. The electron emission device shown in FIG. 8 is basically the same as the electron emission device shown in FIG. 7, except that the layers 2 and the control electrodes 4 shown in FIG. 8 have different configurations. The layers 2 and the control electrodes 4 intersect with each other at pixel-forming points or electron emission areas where the layers 2 and the windows 11 of the control electrodes 4 are of a zigzag shape for widening regions where electrons are emitted and also uniformizing irreguarities of electron emission from the respective pixels.

The layers 2 and the control electrodes 4 may extend horizontally and vertically, respectively, i.e., may be angularly shifted by 90° from the position shown in FIGS. 7 and 8.

In each of the above embodiments, the layer of cathode material having a rectangular cross section and the insulative layer are disposed on one surface of the insulative substrate, with the insulative layer being positioned on each side or one side of the layer of cathode material, and the control electrode for drawing electrons from the layer of cathode material is disposed on the insulative layer. Since electrons are emitted from the edges of the cathode layer, it is not necessary to employ a needle-like cathode, and the electron emission device can easily be manufactured.

Inasmuch as the cathode layer and the control electrode can be relatively positioned with high accuracy, the electron emission device can be manufactured with a high yield. The planar display panel or matrix electron emission source which incorporates the electron emission device according to the present invention can emit many electrons uniformly.

Figure 9:
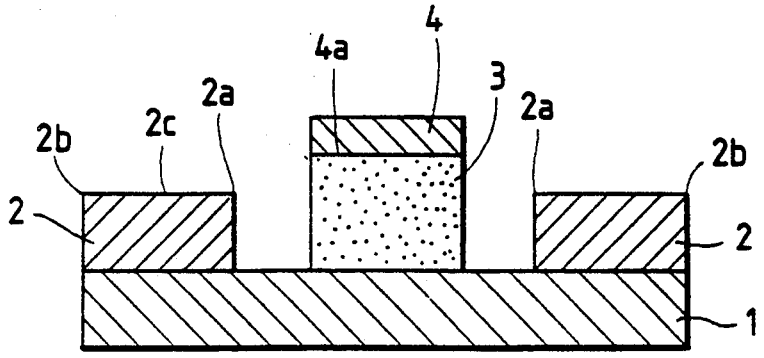
FIGS. 9 and 10 are cross-sectional and perspective views, respectively, of an electron emission device according to a fourth embodiment of the present invention.
Figure 10:
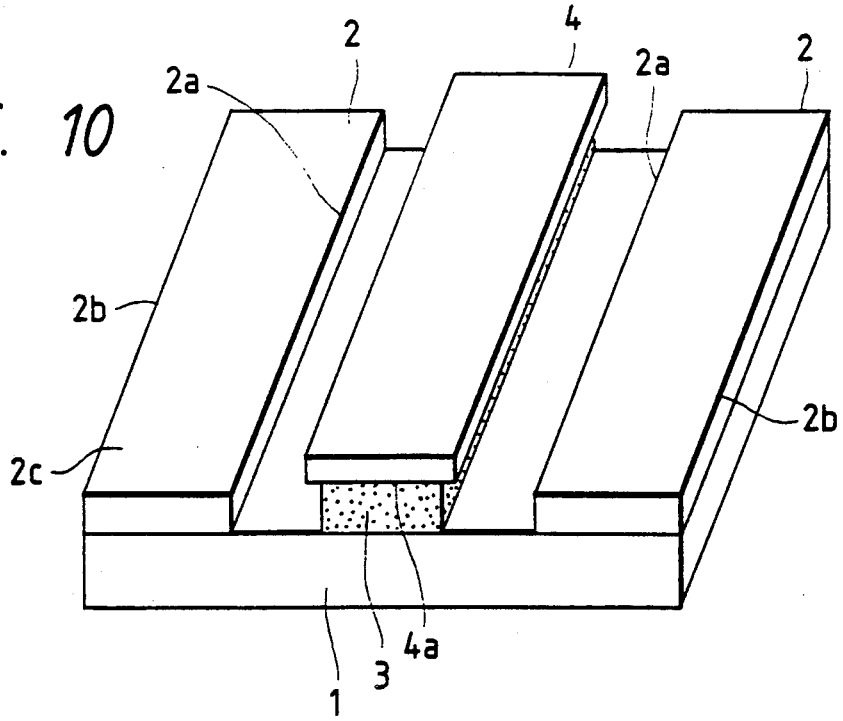
Figure 11A:
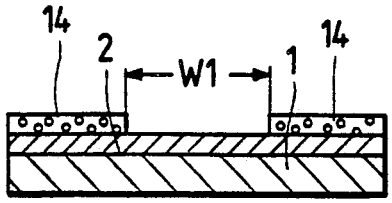
FIGS. 11(*a*) through 11(*e*) are cross-sectional views showing a process of manufacturing the electron emission device according to the fourth embodiment.
Figure 11B:
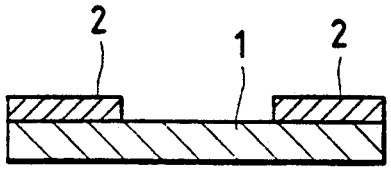
Figure 11C:
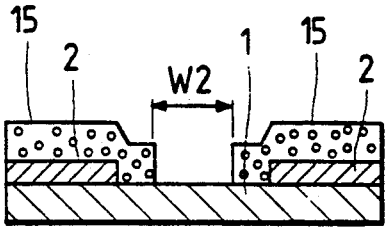
Figure 11D:
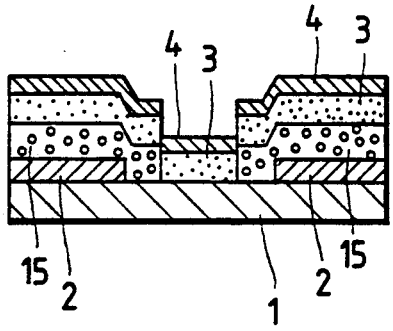
Figure 11E:
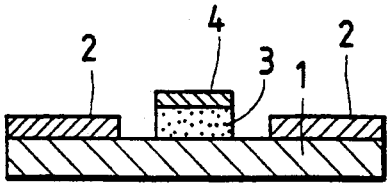

An electron emission device according to a fourth embodiment of the present invention will be described below with reference to FIGS. 9 and 10.

Two spaced layers 2 of a cathode material such as Mo, Ta, W, ZrC, TiC, SiC, $LaB_6$, or the like are disposed on an electrically insulative substrate 1 of glass, ceramic, or the like. On a central surface of the insulative substrate 1, there is disposed an electrically insulative layer 3 of $SiO_2$, $SiO_3N_4$, $Al_2O_3$, or the like which is positioned inwardly of and between confronting edges of, or surrounded by, the layers 2 in spaced relation thereto. A control electrode 4 for drawing electrodes, which is made of a metal such as Mo, Ta, W, or the like, or any of various other electrically conductive materials, is disposed on the insulative layer 3. The control electrode 4 has a bottom surface 4*a* lying at the same height as or higher than upper surfaces 2*c* of the cathode layer 2. Each of the cathode layers 2 is of a rectangular cross section and has opposite edges 2*a*, 2*b*. The edges 2*a* of the cathode layers 2 confront the control electrode 4. The electron emission device thus constructed serves as a linear, one-dimensional electron emission device.

The electron emission device shown in FIGS. 9 and 10 operates as follows:

The control electrode 4 and the layers 2 are connected to a power supply (not shown) such that the control electrode 4 is held at a positive potential and the layers 2 at a negative potential. When a voltage higher than a predetermined voltage depending on the cathode material of the layers 2 is applied between the layers 2 and the control electrode 4, the edges 2*a*, 2*b* of the layer 2 emit electrons. The direction in which the emitted electrons travel is determined by the electric field developed between the control electrode 4 and the layers 2. Some of the electrons enter the control electrode 4, while the other electrons fly upwardly of the control electrode 4. Inasmuch as the control electrode 4 is disposed between or surrounded by the layers 2, most of the electrons emitted from the layers 2 are directed upwardly of the control electrode 4. Because the bottom surface 4*a* of the control electrode 4 is as high as or higher than the upper surfaces 2*c* of the layers 2, the electrons emitted from the layers 2 travel at a velocity whose upward component is large. Therefore, the number of electrons flying over or upwardly of the control electrode 4, i.e., the intensity of the electron beams from the layers 2, is increased. Since the edges 2*a* of the layers 2 are disposed in confronting relation to the control electrode 4, respectively, the electric field produced between the control electrode 4 and the layers 2 is concentrated on the edges 2*a*, thus increasing the effective field strength at the edges 2*a* for electron emission, with the advantage that the voltage applied to emit electrons may be reduced.

A process of manufacturing the electron emission device shown in FIGS. 9 and 10 will be described below with reference to FIGS. 11(*a*) through 11(*e*).

First, as shown in FIG. 11(*a*), a thin film of a cathode material such as Mo, Ta, W, ZrC, TiC, SiC, $LaB_6$, or the like, which will form cathode layers 2, is deposited to a thickness ranging from 300 nm to 500 nm on an electrically insulative substrate 1 of glass, ceramic, or the like by a thin film fabrication process such as electron beam evaporation, sputtering, ion beam evaporation, screen printing, or the like. Then, resists 14 are deposited on opposite sides of the thin film by photolithography, the resists 14 being spaced from each other by a distance Wl ranging from 5 μm to 60 μm and having a length ranging from 10 μm to 1 mm. Thereafter, as shown in FIG. 11(*b*), a central area of the thin film, which is not covered with the resists 14, is etched away by an etching solution, which may be a mixed solution of $H_3PO_4$, $CH_3COOH$, $HNO_3$, and $H_2O$ for Mo, or a mixed acid of $HNO_3$ and HF for Ta. Then, the resists 14 are removed, leaving layers 2 of cathode material on the opposite sides of the insulative substrate 1. As shown in FIG. 11(*c*), resists 15 are deposited in covering relation to the layers 2, respectively, by photolithography, the resists 15 being spaced from each other by a distance ranging from 3 μm to 50 μm and having a length ranging from 10 μm to 1 mm. Then, as shown in FIG. 11(*d*), a thin film of $SiO_2$, $Al_2O_3$, $Si_3N_4$, or the like, which will form an insulative layer 3, and then a thin film of Mo, Cr, Ta, W, or the like, which will form a control electrode 4, are deposited to a thickness ranging from 500 nm to 1 μm and a thickness ranging from 200 nm to 300 nm, respectively, on the surface formed thus far by ECR plasma CVD, electron beam evaporation, sputtering, ion beam evaporation, of the like. Thereafter, the resists 15 are lifted off together with the thin films thereon, leaving the central thin films which serve respectively as the insulative layer 3 and the control electrode 4. The linear, one-dimensional electron emission device shown in FIGS. 9 and 10 is now completed.

A voltage was applied to the electron emission device thus fabricated with the control electrode 4 at a positive potential and the layers 2 at a negative potential. When a voltage ranging from 50 V to 80 V was applied, the electron emission device started emitting electrons. When a voltage of 100 V was applied, an emission current ranging from 50 μA to 100 μA was produced. When the electron beam emitted from the electron emission device was focused on a fluorescent surface by a focusing electrode, the fluorescent surface displayed a good linear electron beam pattern or image having a width ranging from 5 μm to 50 μm and a length ranging from 10 μm to 1 mm.

Figure 12:
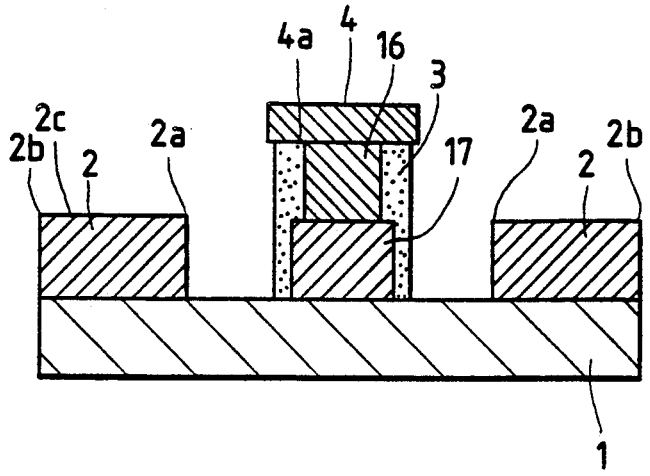
FIG. 12 is a cross-sectional view of an electron emission device according to a fifth embodiment of the present invention.

FIG. 12 illustrates an electron emission device according to a fifth embodiment of the present invention. The electron emission device shown in FIG. 12 is similar to the electron emission device shown in FIGS. 9 and 10. Therefore, those parts shown in FIG. 12 which are identical to those shown in FIGS. 9 and 10 are denoted by identical reference numerals, and will not be described in detail.

The electron emission device shown in FIG. 12 additionally has an electrically conductive layer 16 disposed in the insulative layer 3 and electrically connected to the control electrode 4 and an electrically conductive layer 17 disposed in the insulative layer 3 and electrically connected to the conductive layer 16. The conductive layer 17 is disposed centrally on the insulative substrate 1 and is of a long configuration extending in a direction normal to the sheet of FIG. 12. The conductive layer 17 serves as a lead electrically connected to the control electrode 4, for applying a voltage between the control electrode 4 and the cathode layers 2.

When a voltage, which is higher than a certain voltage depending on the cathode material of the layers 2, is applied between the control electrode 4 through the conductive layers 16, 17 and the cathode layers 2, with the control electrode 4 at a positive potential and the cathode layers 2 at a negative potential, electrons are emitted from the edges 2*a* of the cathode layer 2 and combined into a concentrated electron beam at the center of the electron emission device by the control electrode 4. Since the electric field produced between the control electrode 4 and the cathode layer 2 is concentrated on the edges 2*a*, the effective field strength is increased to facilitate electron emission from the edges 2a. As a consequence, the voltage applied to the electron emission device for electron emission is lowered.

FIGS. 13(a) through 13(e) show a process of manufacturing the electron emission device shown in FIG. 12.

Figure 13A:
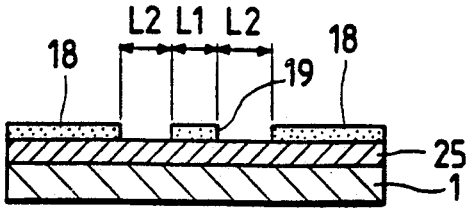
FIGS. 13(*d*) through 13(*e*) are cross-sectional views showing a process of manufacturing the electron emission device according to the fifth embodiment.
Figure 13B:
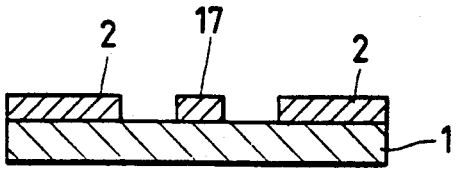
Figure 13C:
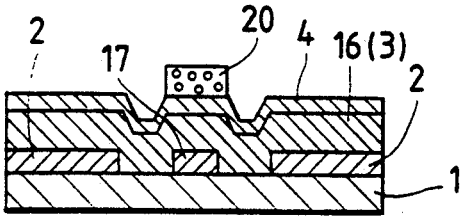
Figure 13D:
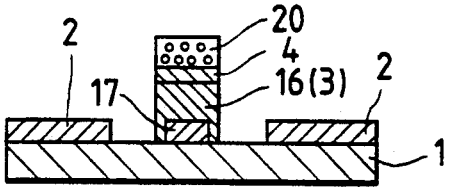
Figure 13E:
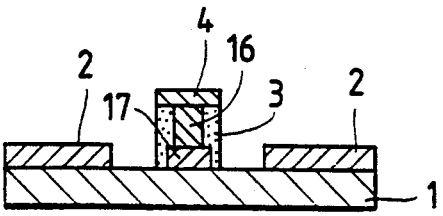

First, as shown in FIG. 13(a), a thin film of a cathode material such as Mo, W, ZrC, LaB., or the like, which will form cathode layers 2 and an electrically conductive layer 17, is deposited to a thickness ranging from 300 nm to 500 nm on an electrically insulative substrate 1 of glass, ceramic, or the like by a thin film fabrication process. Then, resists 18, 19 are deposited on opposite sides and a central area of the thin film by photolithography, the resist 19 having a width L1 ranging from 3 μm to 50 μm and being spaced from the resists 18 by a distance L2 ranging from 5 μm to 10 μm. The resists 18, 19 have a length ranging from 10 μm to 1 mm. Thereafter, as shown in FIG. 13(b), those areas of the thin film which are not covered with the resists 18, 19, are etched away by an etching solution. Then, the resists 18, 19 are removed, leaving layers 2 of cathode material on the opposite sides of the insulative substrate 1 and an electrically conductive layer 17 on the central area thereof. As shown in FIG. 13(c), a thin film such as Al, Ta, or the like, which will form an insulative layer 3 and an electrically conductive layer 16, and then a thin film of Mo, Cr, W, or the like, which will form a control electrode 4, are deposited to a thickness ranging from 500 nm to 1 μm and a thickness ranging from 200 nm to 300 nm, respectively, on the surface formed thus far by evaporation or the like. In addition, a resist 20 having a width ranging from 5 μm to 60 μm and a length ranging from 10 μm to 1 mm is deposited centrally on the uppermost thin film by evaporation or the like. As shown in FIG. 13(d), the two thin films which are not covered with the resist 20 are etched away, thereby leaving the thin films beneath the resist 20. The upper thin film serves as a control electrode 4. Then, as shown in FIG. 13(e), outer surfaces of the thin film below the control electrode 4 are anodized with the control electrode 4 connected as an anode, thereby forming an insulative layer 3. If the thin film beneath the control electrode 4 is made of Al, then the insulative layer 3 is made of $Al_2O_3$ with an electrically conductive layer 16 of Al being disposed therein. If the thin film beneath the control electrode 4 is made of Ta, the insulative layer 3 is made of $Ta_2O_5$ with an electrically conductive layer 16 of Ta being disposed therein. Thereafter, the resist 20 is removed, completing the linear, one-dimensional electron emission device shown in FIG. 12.

The electron emission device thus fabricated was tested for electron emission characteristics in the same manner as with the fourth embodiment. When a voltage of 100 V was applied, an emission current ranging from 50 Å to 100 Å was produced. When the electron beam emitted from the electron emission device was focused on a fluorescent surface by a focusing electrode, the fluorescent surface displayed a good linear electron beam pattern or image having a width ranging from 5 μm to 50 μm.

Figure 14:
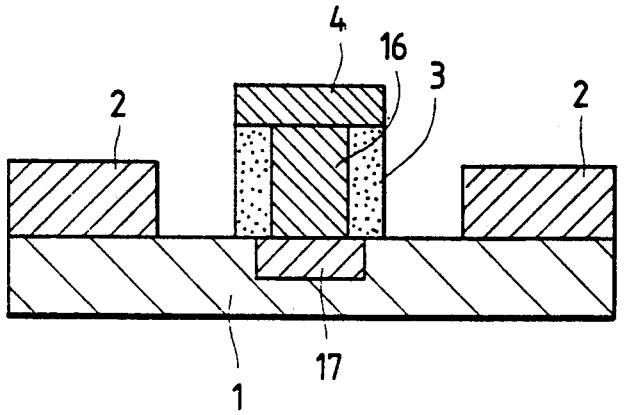
FIG. 14 is a cross-sectional view of an electron emission device according to a sixth embodiment of the present invention.

FIG. 14 illustrates an electron emission device according to a sixth embodiment of the present invention. In the fifth embodiment, the conductive layer 17 is disposed on the insulative substrate 1. According to the sixth embodiment, the conductive layer 17 is embedded in the insulative substrate 1, and the conductive layer 16, the insulative layer 3, and the control electrode 4 are disposed on the conductive layer 17 and the insulative substrate 1. The cathode layers 2 are disposed on the insulative substrate 1 one on each side of or in surrounding relation to the conductive layer 16, the insulative layer 3, and the control electrode 4. The electron emission device according to the sixth embodiment also offers the same advantages as the electron emission devices according to the fourth and fifth embodiments.

Figure 15:
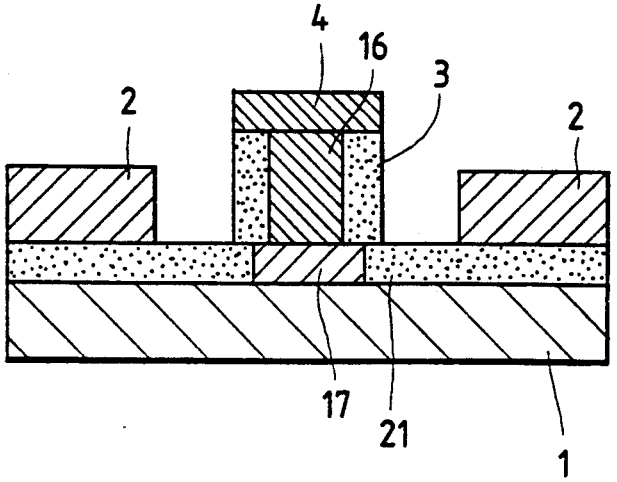
FIG. 15 is a cross-sectional view of an electron emission device according to a seventh embodiment of the present invention.

FIG. 15 shows an electron emission device according to a seventh embodiment of the present invention. In the seventh embodiment, an electrically insulative layer 21 is disposed on the insulative substrate 1, and the conductive layer 17 is embedded in the insulative layer 21. The conductive layer 16, the insulative layer 3, and the control electrode 4 are disposed on the conductive layer 17 and the insulative substrate 21. The cathode layers 2 are disposed on the insulative substrate 21 one on each side of or in surrounding relation to the conductive layer 16, the insulative layer 3, and the control electrode 4. The electron emission device according to the seventh embodiment also offers the same advantages as the electron emission devices according to the fourth and fifth embodiments.

Figure 16A:
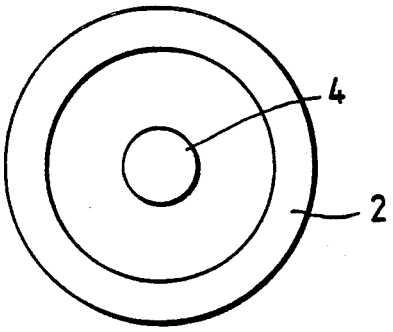
FIGS. 16(*a*) through 16(*c*) are plan views of electron emission devices according to eighth through tenth embodiments, respectively, of the present invention.
Figure 16B:
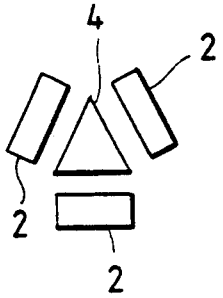
Figure 16C:
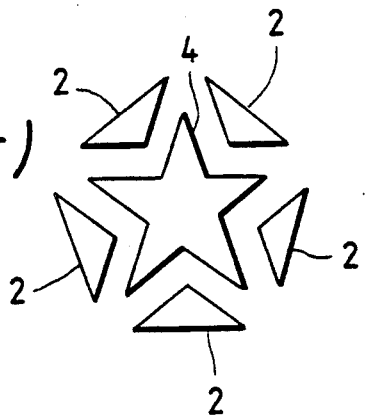

FIGS. 16(a) through 16(c) show, in plan, electron embodiments, respectively, of the present invention.

In each of the fourth through seventh embodiments, the electron emission device is in the form of a linear, one-dimensional electron emission device. According to the eighth through tenth embodiments, as shown in FIGS. 16(a) through 16(c), a control electrode 4 is disposed in a central position, and a layer 2 of cathode material is disposed in surrounding relation to the control electrode 4. More specifically, in FIG. 16(a), a circular control electrode 4 is surrounded by a ring-shaped cathode layer 2. In FIG. 16(b), al. a triangular control electrode 4 is surrounded by three rectangular cathode layers 2. In FIG. 16(c), a five pointed star-shaped control electrode 4 is surrounded by five triangular cathode layers 2. The electron emission devices shown in FIGS. 16(a) through 16(c) are as advantageous as the electron emission devices according to the fourth and fifth embodiments.

The control electrode 4 and the cathode layer or layers 2 are however not limited to the illustrated shapes in the above embodiments.

In the fourth through tenth embodiments, since the control electrode is disposed inwardly of the cathode layer or layers, the electron beam which is emitted from the cathode layer or layers when a voltage is applied between the cathode layer or layers and the control electrode is caused to travel upwardly of the control electrode, i.e., toward the center of the electron emission device. Therefore, the emitted electron beam is converged, and hence is of highly defined, high-quality nature. Since the electron emission device is simple in structure, it can easily be manufactured with a high yield, and is highly reliable in operation. As the edges of the cathode layer or layers confront the control electrode, the produced electric field is concentrated on the edges, so that the voltage required by the electron emission device for electron emission may be low.

Figure 17A:
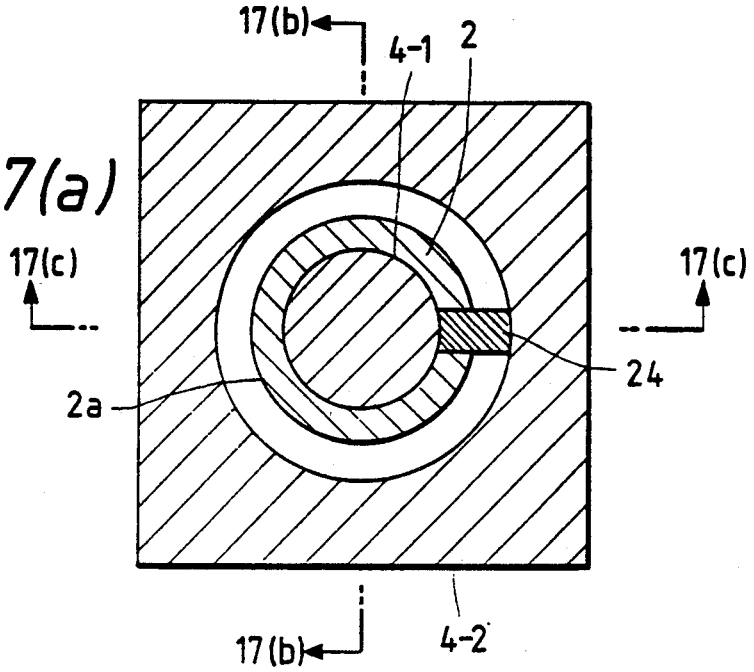
FIG. 17(*a*) is a plan view of an electron emission device according to an eleventh embodiment of the present invention.
Figure 17B:
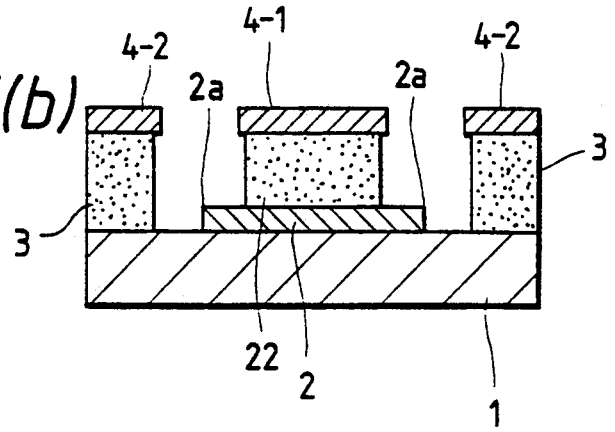
Figure 17C:
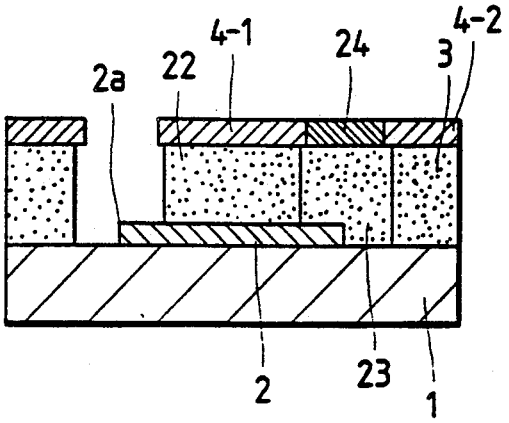

FIGS. 17(a) through 17(c) illustrate an electron emission device according to an eleventh embodiment of the present invention.

A circular layer 2 of a cathode material such as Mo, Ta, W, ZrC, $LaB_6$, or the like is disposed centrally on an electrically insulative substrate 1 of glass, ceramic, or the like. On the cathode layer 2, there is disposed an electrically insulative layer 22 of $SiO_2$, $SiO_3N_4$, $Al_2O_3$, or the like which is small enough to allow an outer edge 2a of the cathode layer 2 to be exposed. A first control electrode 4-1 of Mo, Ta, Cr, Al, Au, or the like is disposed on the insulative layer 22. An electrically insulative layer 3 of $SiO_2$, $SiO_3N_4$, $Al_2O_3$, or the like is disposed on an outer peripheral marginal edge of the insulative substrate 1 around the cathode layer 2, the insulative layer 22, and the first control electrode 4-1 in radially spaced relation thereto. A second control electrode 4-2 of Mo, Ta, Cr, Al, Au, or the like is disposed on the insulative layer 3. The first and second control electrodes 4-1, 4-2 are electrically connected to each other. More specifically, as shown in FIGS. 17(a) and 17(c), an electrically insulative layer 23 of $SiO_2$, $SiO_3N_4$, $Al_2O_3$, or the like is disposed on an exposed area of the cathode layer 2 and an exposed area of the insulative substrate 1 which lies between the cathode layer 2 and the surrounding insulative layer 3. The first and second control electrodes 4-1, 4-2 are electrically connected by an electric connector 24 of Mo, Ta, Cr, Al, Au, or the like which is disposed on the insulative layer 23.

Operation of the electron emission device shown in FIGS. 17(a) through 17(c) will be described below.

The layer 2 and the first and second control electrodes 4-1, 4-2 are connected to a power supply (not shown) such that the layer 2 is held at a negative potential and the first and second control electrodes 4-1, 4-2 at a positive potential. When a voltage higher than a predetermined voltage depending on the cathode material of the layer 2 is applied between the layer 2 and the control electrodes 4-1, 4-2, a developed electric field is concentrated on the edge 2a of the layer 2 to cause the edge 2a to emit electrons into a surrounding evacuated space. The emitted electrons travel along electric lines of force that are determined under the applied voltage between the first and second control electrodes 4-1, 4-2 and the layer 2. If the first control electrode 4-1 did not exist, the electric lines of force would be directed toward the second control electrode 4-2, i.e., radially outwardly from the center of the electron emission device, so that the electron beam would spread apart. Since the first control electrode 4-1 is disposed at the center of the electron emission device, the generated electron beam is directed toward the center of the electron emission device, rather than radially outwardly, and hence is concentrated into a highly defined, high-quality electron beam.

The insulative layer 3 and the second control electrode 4-2 may be disposed on each side of the cathode layer 2, the insulative layer 22, and the first control electrode 4-1, rather than surround them as shown.

Figure 18A:
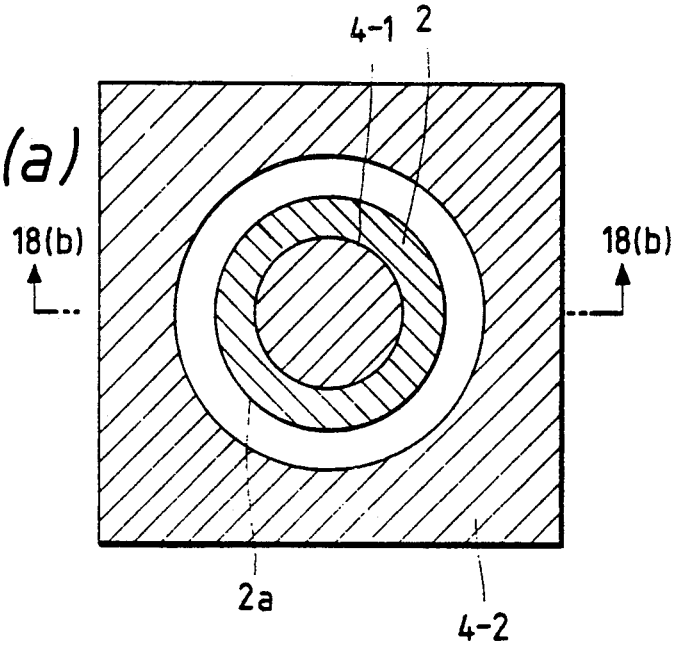
FIG. 18(*a*) is a plan view of an electron emission device according to a twelfth embodiment of the present invention.
Figure 18B:
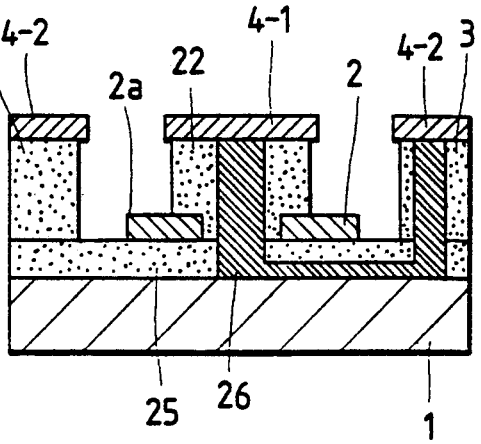

FIGS. 18(a) and 18(b) show an electron emission device according to a twelfth embodiment of the present invention.

An electrically insulative substrate 1 supports thereon an electrically insulative layer 25, and a ring-shaped layer 2 of cathode material is disposed centrally on the insulative layer 25. Another electrically insulative layer 22 is disposed on the the ring-shaped layer 2 of the cathode material and an exposed area which lies, on the inward side of the ring-shaped cathode layer 2. The insulative layer 22 is small enough to expose an outer edge 2a of the cathode layer 2. A first control electrode 4-1 is disposed on the insulative layer 22. An electrically insulative layer 3 is disposed on an outer peripheral marginal edge of the insulative substrate 25 around the cathode layer 2, the insulative layer 22, and the first control electrode 4-1 in radially spaced relation thereto. A second control electrode 4-2 of is disposed on the insulative layer 3. The first and second control electrodes 4-1, 4-2 are electrically connected to each other by an insulated electric connector 26 which extends through the inside of the insulative layer 22, the inside of the insulative layer 25, and the inside of the insulative layer 3.

The components of the electron emission device shown in FIGS. 18(a) and 18(b) are of the same materials as those of the electron emission device according to the eleventh embodiment. Also, the electron emission device shown in FIGS. 18(a) and 18(b) operates in the same manner as the electron emission device according to the eleventh embodiment.

Figure 19:
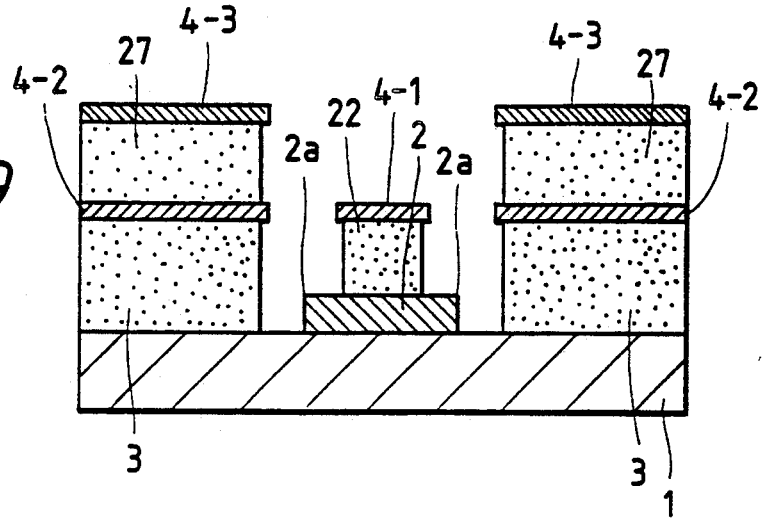
FIG. 19 is a cross-sectional view of an electron emission device according to a thirteenth embodiment of the present invention.

An electron emission device according to a thirteenth embodiment of the present invention is shown in FIG. 19. Those parts of the electron emission device shown in FIG. 19 which are identical to the electron emission device according to the eleventh embodiment shown in FIGS. 17(a) through 17(c) are denoted by identical reference numerals, and will not be described in detail. As shown in FIG. 19, the electron emission device additionally includes an electrically insulative layer 27 of $SiO_2$, $SiO_3N_4$, $Al_2O_3$, or the like disposed on the second control electrode 4-2, and a third control electrode 4-3 of Mo, Ta, W, Cr, Al, Au, or the like disposed on the insulative layer 27.

The electron emission device shown in FIG. 19 operates as follows:

The layer 2 and the first and second control electrodes 4-1, 4-2 are connected to a power supply (not shown) such that the layer 2 is held at a negative potential and the first and second control electrodes 4-1, 4-2 at a positive potential. When a voltage higher than a predetermined voltage depending on the cathode material of the layer 2 is applied between the layer 2 and the control electrodes 4-1, 4-2, a developed electric field is concentrated on the edge 2a of the layer 2 to cause the edge 2a to emit electrons into a surrounding evacuated space. The emitted electrons is caused by the first control electrode 4-1 to travel toward the center of the electron emission device, resulting in a convergent electron beam, as described before with reference to the eleventh embodiment. If the voltage applied between the cathode layer 2 and the first and second control electrodes 4-1, 4-2 were lower than the predetermined voltage, no electrons would be emitted from the cathode layer 2 into the surrounding evacuated space. Therefore, the number of electrons emitted from the cathode layer 2 can be controlled when the voltage applied between the cathode layer 2 and the first and second control electrodes 4-1, 4-2 is controlled. When the third control electrode 4-3 is kept at a potential higher than the potential of the first and second control electrodes 4-1, 4-2, the electrons emitted in the evacuated space are accelerated upwardly of the electron emission device. Consequently, the electron beam can easily be drawn from the electron emission device while being prevented from spreading outwardly therefrom.

FIGS. 20(a) through 20(g) show a process of manufacturing the electron emission device illustrated in FIG. 19.

Figure 20A:
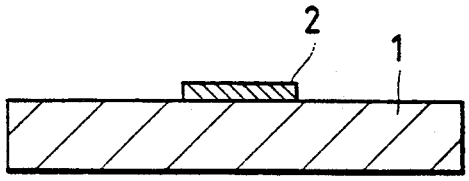
FIGS. 20(*a*) through 20(*g*) are cross-sectional views showing a process of manufacturing the electron emission device according to the thirteenth embodiment.
Figure 20B:
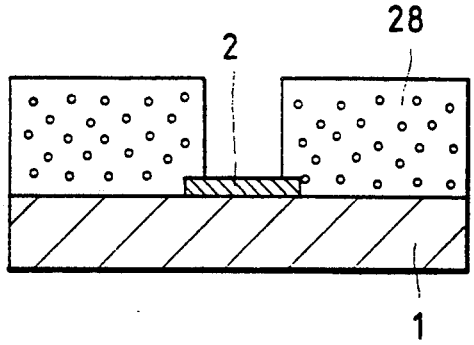
Figure 20C:
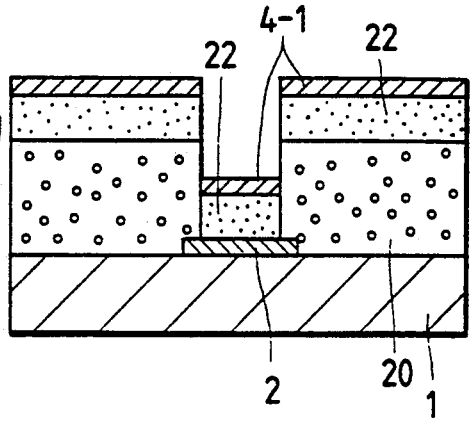
Figure 20D:
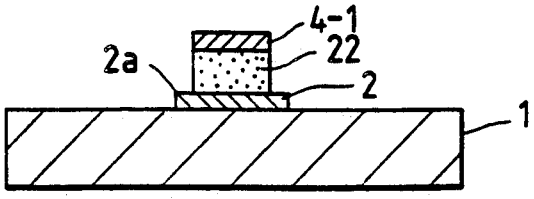
Figure 20E:
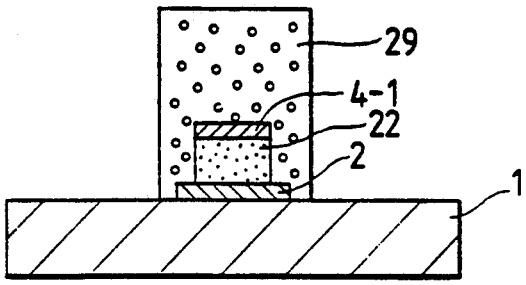
Figure 20F:
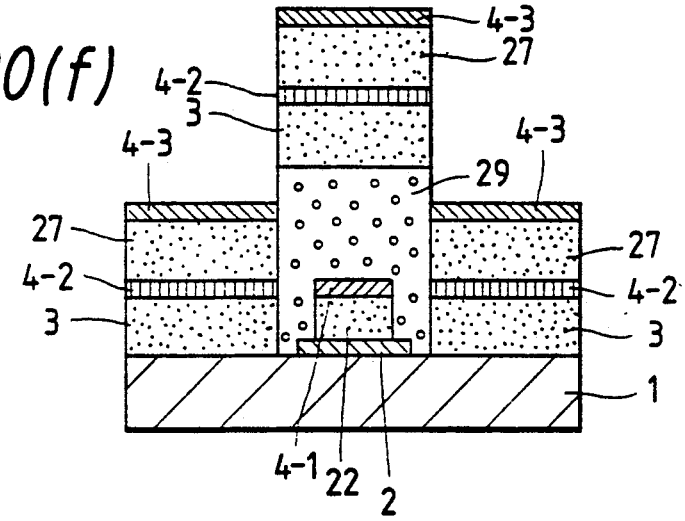
Figure 20G:
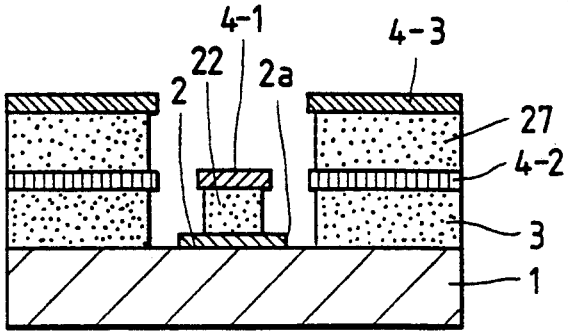

As shown in FIG. 20(a), a layer 2 of a cathode material such as Mo, W, or the like is deposited by sputtering on a central area of an electrically insulative substrate 1 of glass which has a thickness of 1 mm. The layer 2 has a thickness ranging from 200 nm to 400 nm, a width ranging from 10 μm to 50 μm, and a length of 200 μm.

Then, as shown in FIG. 20(*b*), resists 28 having a thickness of 1.5 μm and spaced from each other by a distance ranging from 5 μm to 48 μm are deposited on an exposed area of the insulative substrate 1 and opposite sides of the cathode layer 2. As shown in FIG. 20(*c*), a film of $SiO_2$ or the like, which will form an electrically insulative layer 22, and a electrically conductive film of Mo, Cr, or the like, which will form a first control electrode 4-1, are successively deposited to a thickness ranging from 800 nm to 1 μm and a thickness ranging from 200 nm to 400 nm, respectively, on the resist 28 and the cathode layer 2 by electron beam evaporation or sputtering. Then, the resist 28 is lifted off, thereby forming an electrically insulative layer 22 and a first control electrode 4-1 on the cathode layer 2, as shown in FIG. 20(*d*). As shown in FIG. 20(*e*), a mask 29 is disposed in covering relation to the first control electrode 4-1, the insulative layer 22, the cathode layer 2, and an exposed area of the insulative substrate 1, the mask 29 having a width ranging from 12 μm to 55 μm and a thickness of 2.5 μm. Then, as shown in FIG. 20(*f*), a film of $SiO_2$, which will form an electrically insulative layer 3, an electrically conductive film of Mo or Cr, which will form a second control electrode 4-2, a film of $SiO_2$ or the like, which will form an electrically insulative layer 27, and an electrically conductive film of Mo or Cr, which will form a third conductive electrode 4-3, are successively deposited to a thickness ranging from 800 nm to 1 μm, a thickness ranging from 200 nm to 400 nm, a thickness ranging from 800 nm to 1 μm, and a thickness ranging from 200 nm to 400 nm, respectively, on the surface thus far by electron beam evaporation or sputtering. Thereafter, the mask 29 is lifted off, providing an electron emission device including a second control electrode 4-2 and a third control electrode 4-3, as shown in FIG. 20(*g*). When an electron beam emitted from the electron emission device thus fabricated was focused on a fluorescent surface by a focusing electrode, the fluorescent surface displayed a good linear electron beam pattern or image having a width ranging from 10 μm to 55 μm and a length of 200 μm.

In the eleventh through thirteenth embodiments, the electron beam which is emitted from the cathode layer when a voltage is applied between the cathode layer and the first and second control electrodes is prevented by the first control electrode from traveling toward the second control electrode, i.e., toward the center of the electron emission device. Therefore, the emitted electron beam is converged, and hence is of highly defined, high-quality nature. Since the electron emission device is simple in structure, it can easily be manufactured with a high yield, and is highly reliable in operation.

The third control electrode is effective to accelerate the emitted electron beam, which can thus be drawn easily and stably from the electron emission device.

Figure 21A:
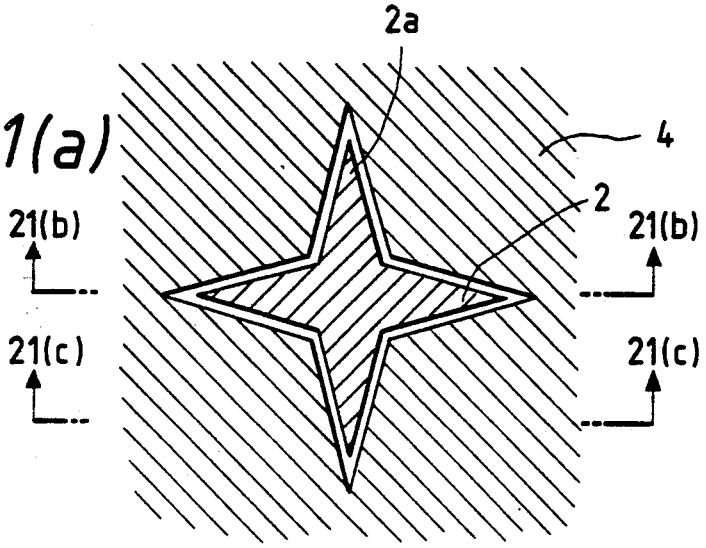
FIG. 21(*a*) is a plan view of an electron emission device according to a fourteenth embodiment of the present invention.
Figure 21B:
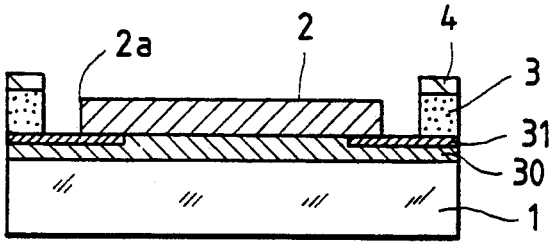
Figure 21C:
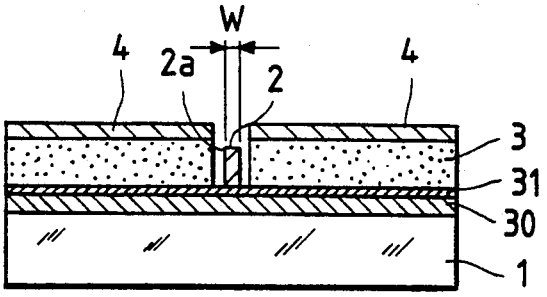
Figure 22A:
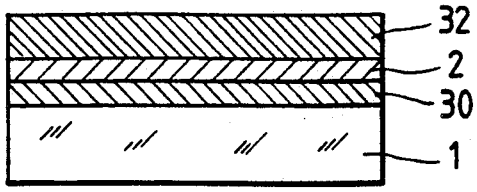
FIGS. 22(*a*) through 22(*f*) are cross-sectional views showing a process of manufacturing the electron emission device according to the fourteenth embodiment.
Figure 22B:
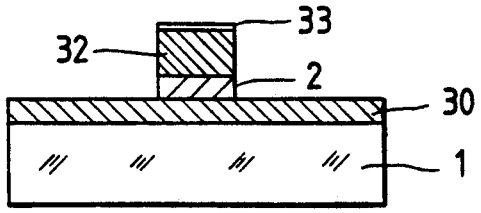
Figure 22C:
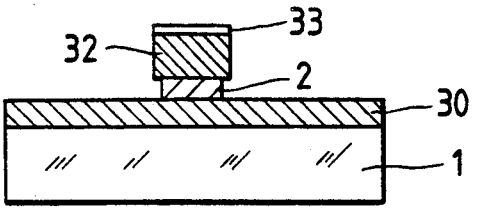
Figure 22D:
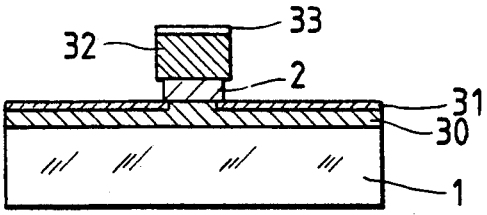
Figure 22E:
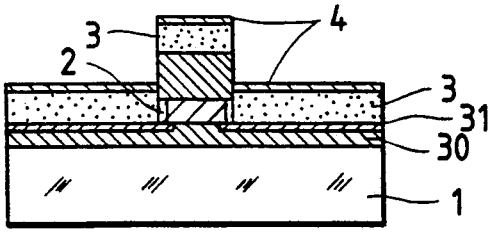
Figure 22F:
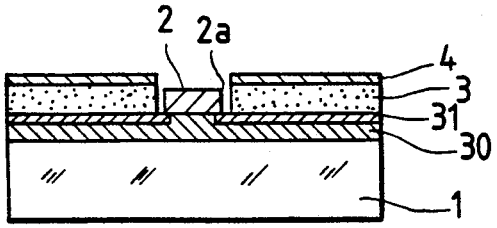
Figure 23A:
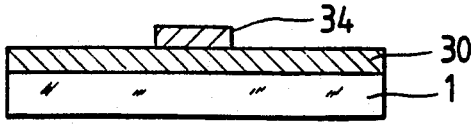
FIGS. 23(*a*) through 23(*g*) are cross-sectional views showing another process of manufacturing the electron emission device according to the fourteenth embodiment.
Figure 23B:
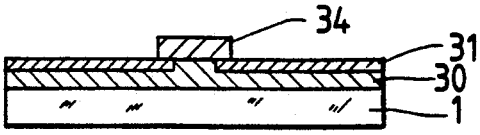
Figure 23C:
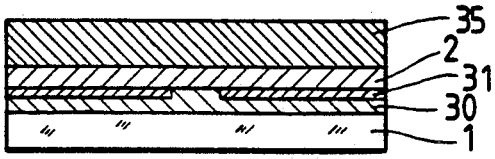
Figure 23D:
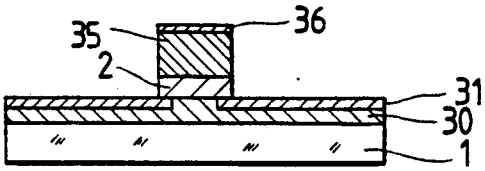
Figure 23E:
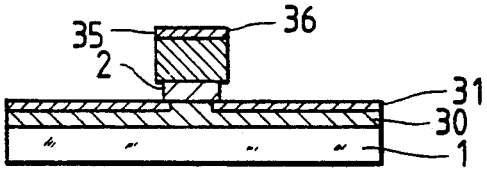
Figure 23F:
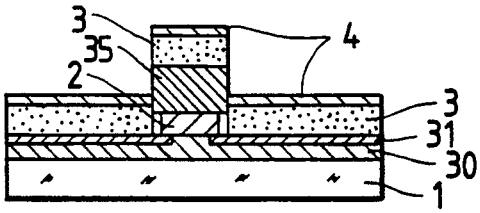
Figure 23G:
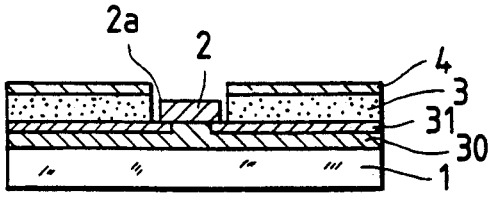

FIGS. 21(*a*) through 21(*c*) illustrate an electron emission device according to a fourteenth embodiment of the present invention.

A base electrode 30 of electrically conductive material is disposed on an electrically insulative substrate 1 of glass or the like, and a layer 2 of cathode material, to which an electric current is supplied from the base electrode 30, is disposed on the base electrode 30. The cathode material of the layer 2 may be a material having a high work function and a high melting point, such as SiC, ZrC, TiC, Mo, W, or the like, for example. The cathode layer 2 is of a four-pointed star-shaped or criss-cross configuration, as viewed in plan, and has a rectangular or trapezoidal cross section which has an outer edge 2*a*. The cathode layer 2 has four outwardly extending arms each having a wedge shape as viewed in plan, the arm having a width W that varies progressively linearly from zero to a certain dimension in an inward direction from the distal end toward the center of the cathode layer 2. However, the cathode layer 2 is not limited to the illustrated configuration, the the width W may not necessarily vary linearly providing it should vary progressively. The electron emission device also includes an electrically insulative layer 31 which is disposed on the base electrode 30 in an area beneath an outer marginal edge of the cathode layer 2 and in an outer area free of or not covered by the cathode layer 2. An electrically insulative layer 3 is disposed on the insulative layer 31 and outwardly spaced from the cathode layer 2 in complementarily surrounding relation thereto, and a control electrode 4 is disposed on the insulative layer 3. The insulative layer 3 is made of a material such as $Al_2O_3$, $SiO_2$, or the like, and has a thickness equal to or greater than the thickness of the cathode layer 2. The control electrode 4, which serves to draw electrons from the cathode layer 2, is made of metal or the like.

The electron emission device shown in FIGS. 21(*a*) through 21(*c*) operates as follows:

A voltage is applied between the cathode layer 2 and the control electrode 4 such that the cathode layer 2 is kept at a negative potential and the control electrode 4 at a positive potential. Electric lines of force are concentrated on an outer edge 2*a* of the cathode layer 2, developing an intensive electric field at the edge 2*a*. Since the wedge-shaped arms of the cathode layer 2 and the complementarily wedge-shaped recesses of the control electrode 4 have varying widths, the field strength of the electric field at the outer edge 2*a* varies depending on the position on the cathode layer 2. Therefore, even if the cathode layer 2 and the control electrode 4 have pattern accuracy differences when they are formed, the cathode layer 2 always has edge areas where there is developed a field strength required to emit electrons therefrom. Consequently, the electron emission device has stable electron emission characteristics. The control electrode 4 is positioned at the same height as or higher than the upper surface of the cathode layer 2, so that electrons emitted from the edge 2*a* of the cathode layer 2 are prevented from spreading, but are controlled to travel in a direction substantially perpendicular to the upper surface of the cathode layer 2. Accordingly, the emitted electron beam is well defined and of high quality. The wedge-shaped arms of the cathode layer 2 have pointed outer ends on which the electric field can be concentrated for directing the electron beam perpendicularly to the upper surface of the cathode layer 2.

A process of manufacturing the electron emission device shown in FIGS. 21(*a*) through 21(*c*) will be described below with reference to FIGS. 22(*a*) through 22(*f*).

As shown in FIG. 22(*a*), a base electrode 30 of an electrically conductive material such as Al, Ta, or the like is deposited to a predetermined thickness on an electrically insulative substrate 1 of glass or the like by vacuum evaporation, sputtering, or the like. Then, an electrically conductive film of SiC, ZrC, TiC, Mo, W, or the like, which will form a cathode layer 2, is deposited to a predetermined thickness on the base electrode 30. In addition, a film 32 of liftoff material is deposited on the uppermost conductive film, the liftoff material film 32 being thicker than an electrically insulative layer 3 (described later). The liftoff material may be a metal or an insulative material which can withstand an etching solution used to etch the cathode layer 2 or such that a solution used to remove the liftoff material film 32 does not erode other materials when the liftoff material will be removed.

Then, as shown in FIG. 22(*b*), a photoresist 33 is deposited on the liftoff material film 32 in a pattern of the cathode layer 2. Using the photoresist 33 as a protective film, the liftoff material film 32 and the conductive film therebeneath are etched away, thus leaving the liftoff material film 32 and the conductive film below the photoresist 33. As shown in FIG. 22(*c*), only the conductive film beneath the liftoff material film 32 is etched at its outer peripheral edge into a pattern smaller than the lift-off material film 32.

Then, as shown in FIG. 22(*d*), at least the surface of the base electrode 30 of conductive material which is not covered with the cathode layer 2 is anodized into an electrically insulative layer 31. If the conductive material of the base electrode 30 is Al, then the oxidized insulative layer 31 of $Al_2O_3$ is formed. If the conductive material of the base electrode 30 is Ta, then the oxidized insulative layer 31 of $Ta_2O_5$ is formed. It is preferable that the insulative layer 31 extend to a certain extent beneath the outer peripheral edge of the cathode layer 2.

As shown in FIG. 22(*e*), the photoresist 33 is removed, and an electrically insulative material, which will form an electrically insulative layer 3, and a metal material, which will form a control electrode 4, are successively deposited on the surface formed thus far by sputtering or the like. The insulative material, which will form an insulative layer 3, is of a thickness equal to or greater than the thickness of the cathode layer 2. Since the photoresist 33 has been removed before the deposition of the insulative material and the metal material, the deposited materials are not smeared by the photoresist 33 which would otherwise be decomposed when the overall assembly is heated to increase the bonding strength between the insulative layer 31, the insulative layer 3, and the control electrode 4. If the insulative layer 3 is to be sputtered, then the surface of the insulative layer 31 should preferably be purified in advance by inert gas ions because foreign matter may have been attached to the insulative layer 31 or it may have been contaminated in the previous steps.

Then, the liftoff material film 32 is removed to remove the insulative layer and the metal layer thereon at the same time, thus exposing the cathode layer 2 including its edge 2*a*. The insulative layer 3 and the control electrode 4 are now formed in surrounding and spaced relation to the cathode layer 2. The metal material of the control electrode 4 should be a chemically and physically stable material so that it is not eroded when the liftoff material film 32 is removed.

FIGS. 23(*a*) through 23(*g*) show another process of manufacturing the electron emission device according to the fourteenth embodiment.

As shown in FIG. 23(*a*), a base electrode 30 of an electrically conductive material such as Al, Ta, Mo, or the like is deposited to a predetermined thickness on an electrically insulative substrate 1 of glass or the like by vacuum evaporation, sputtering, or the like. Then, an electrically insulative film 34 of $SiO_2$, for example, in a pattern of a cathode layer 2 (described later) is deposited on the base electrode 30. More specifically, an insulative film 34 is deposited to a certain thickness on the base electrode 30, a photoresist pattern (not shown) is deposited on the insulative film 34, and the insulative layer 34 is etched, using the photoresist patter as a mask (alternatively, the insulative layer 34 may be a photoresist pattern itself).

Then, as shown in FIG. 23(*b*), at least the exposed surface of the base electrode 30, which is not covered with the insulative layer 34, is processed into an electrically insulative layer 31. More specifically, if the conductive material of the base electrode 30 is Al or Ta, then the exposed surface of the base electrode 30 may be anodized or thermally oxidized in an oxygen atmosphere. If the conductive material of the base electrode 30 is Al, then the oxidized insulative layer 31 of $Al_2O_3$ is formed. If the conductive material of the base electrode 30 is Ta, then the oxidized insulative layer 31 of $Ta_2O_5$ is formed. It is preferable that the insulative layer 31 extend to a certain extent beneath the outer peripheral edge of the insulative layer 34.

Then, as shown in FIG. 23(*c*), the insulative layer 34 is removed, and an electrically conductive film of SiC, ZrC, TiC, Mo, W, or the like, which will form a cathode layer 2, is deposited to a predetermined thickness on the base electrode 30 by vacuum evaporation. In addition, a film 35 of liftoff material is deposited as a covering material on the uppermost conductive film, the liftoff material film 35 being thicker than an electrically insulative layer 3 (described later). The liftoff material may be a metal or an insulative material which can withstand an etching solution used to etch the cathode layer 2 or such that a solution used to remove the liftoff material film 35 does not erode other materials when the liftoff material will be removed.

Then, as shown in FIG. 23(*d*), a photoresist 36 is deposited on the liftoff material film 35 in a pattern of the cathode layer 2, i.e., in the same position as the insulative layer 34. Using the photoresist 33 as a protective film, the liftoff material film 35 and the conductive film therebeneath are etched away, thus leaving the liftoff material film 35 and the conductive film below the photoresist 36 (the liftoff material film 35 may be a photoresist itself). As shown in FIG. 23(*e*), only the conductive film beneath the liftoff material film 35 is etched at its outer peripheral edge into a pattern smaller than the liftoff material film 35.

As shown in FIG. 23(*f*), the photoresist 36 is removed, and an electrically insulative material, which will form an electrically insulative layer 3, and a metal material, which will form a control electrode 4, are successively deposited on the surface formed thus far by sputteringq or the like. The insulative material, which will form an insulative layer 3, is of a thickness equal to or greater than the thickness of the cathode layer 2.

Then, the liftoff material film 35 is removed to remove the insulative layer and the metal layer thereon at the same time, thus exposing the cathode layer 2 including its edge 2*a*. The insulative layer 3 and the control electrode 4 are now formed in surrounding and spaced relation to the cathode layer 2. The metal material of the control electrode 4 should be a chemically and physically stable material so that it is not eroded when the liftoff material film 35 is removed.

Figure 24A:
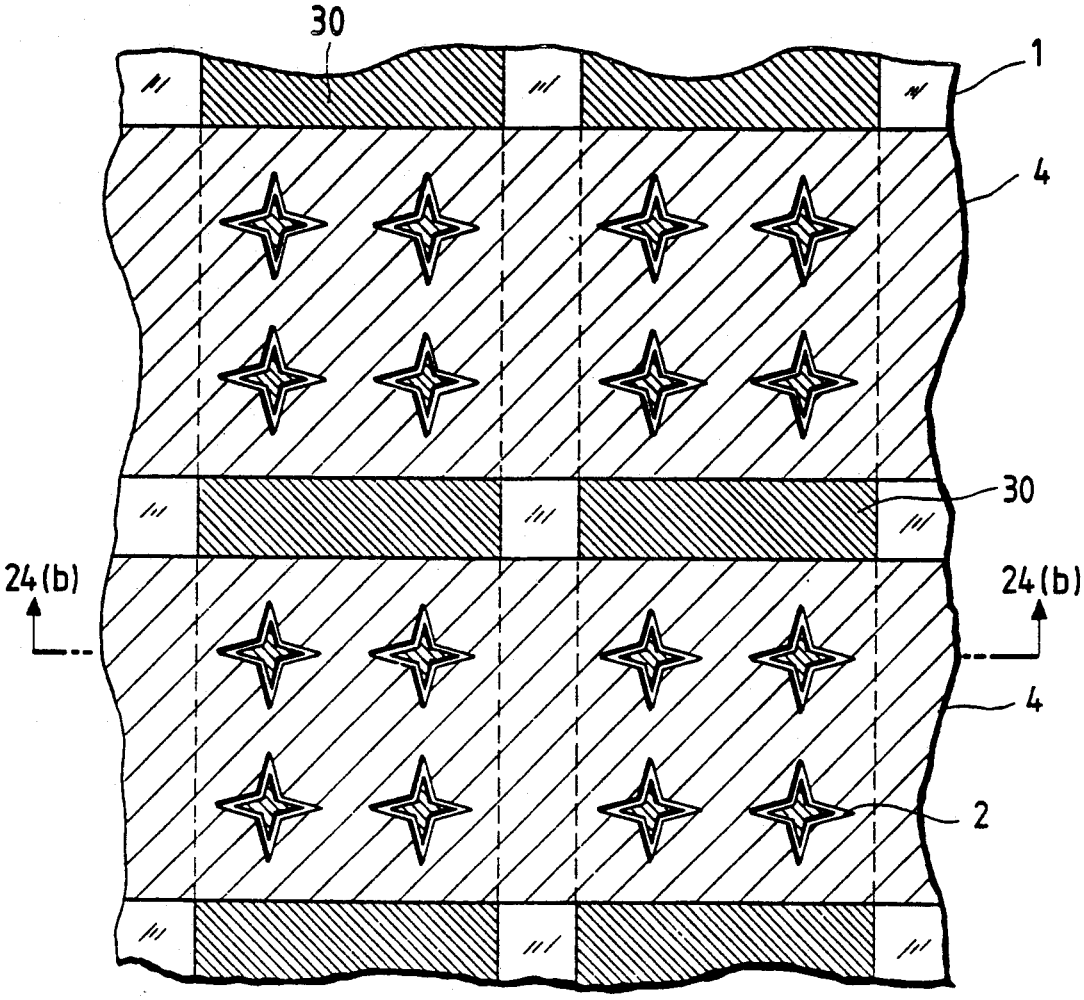
FIG. 24(*a*) is a fragmentary plan view of an electron emission device according to a fifteenth embodiment of the present invention, the electron emission device being incorporated in a planar display panel.
Figure 24B:
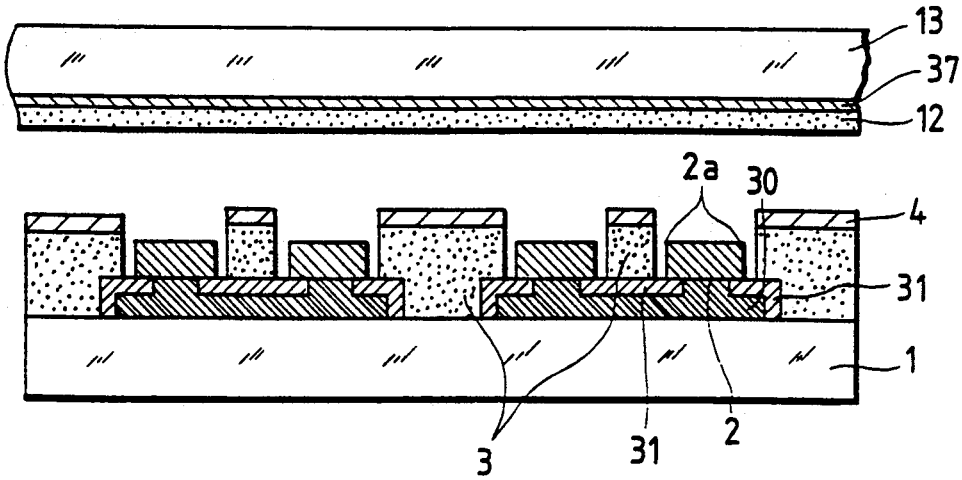

FIGS. 24(*a*) and 24(*b*) show an electron emission device according to a fifteenth embodiment of the present invention, the electron emission device being incorporated in a planar display panel.

As shown in FIGS. 24(*a*) and 24(*b*), a plurality of parallel, vertically elongate striped base electrodes 30 are disposed on an electrically insulative base 1, the base electrodes 30 being horizontally spaced at a predetermined pitch, and a plurality of four-pointed star-shaped cathode layers 2 are disposed on the base electrodes 30. Electrically insulative layers 31 are disposed on at least the surfaces of the base electrodes 30 which are not covered with the cathode layers 2. Electrically insulative layers 3 and control electrodes 4 are successively disposed on the insulative layers 31 and the insulative base 1 and positioned outwardly of or in surrounding relation to the cathode layers 2 in spaced relation thereto. The control electrodes 4 are in a horizontally elongate striped pattern crossing the base electrodes 30 with an overpass at regular angles, and have complementary windows opening over the cathode layers 2. The control electrodes 4 are vertically spaced at a prescribed pitch and are electrically isolated from each other. A transparent substrate 13 is positioned in front of the control electrodes 4 and spaced therefrom. The transparent substrate 13 supports, on its inner surface facing the control electrodes 4, a transparent electrically conductive film 37 and a fluorescent light-emitting layer 12 which are successively disposed thereon. A thin film of Al may be disposed, in place of the transparent conductive film 37, on the light-emitting layer 12, as with an ordinary cathode-ray tube.

The planar display panel thus constructed operates as follows:

For the display of an image in a standard television system, the electron emission device has as many base electrodes 30 supporting cathode layers 2 as the number of pixels in the horizontal direction and as many control electrodes 4 as the number of scanning lines effective to display the image. A given voltage is applied between a selected base electrode 30 and a selected control electrode 4 to develop an intensive electric field for thereby causing the cathode layer 2 to emit electrons. The electrons are then applied to the light-emitting layer 12 which emits light. By varying the voltage applied between the base electrode 30 and the control electrode 4 or the time in which the voltage is applied, the intensity of light emitted from the light-emitting layer 12 is varied. Therefore, when the planar display panel is energized in the same manner as an X-Y-matrix plasma display or a liquid crystal display, the planar display panel can display an image produced by the fluorescent light-emitting layer 12 that glows under electron bombardment.

As described above, the base electrodes 30 and the control electrodes 4 are disposed perpendicularly to each other, and the cathode layers 2 located where the base electrodes 30 and the control electrodes 4 intersect with each other have progressively varying widths to provide many electron emission regions. Therefore, the planar display panel or matrix electron emission source can emits an increased number of electrons per pixel and has uniform electron emission characteristics.

While there are four cathode layers 2 in each point of intersection of the base electrodes 30 and the control electrodes 4 in the illustrated embodiment, more or less cathode layers 2 ma be provided in each point of intersection.

With the electron emission device according to the fourteenth embodiment, since the wedge-shaped arms of the cathode layer 2 have varying widths, even if the cathode layer 2 and the control electrode 4 have pattern accuracy differences when they are formed, the cathode layer 2 always has edge areas where there is developed a field strength required to emit electrons therefrom, and the developed electric field is easily concentrated on those edge areas. Consequently, the electron emission device has stable electron emission characteristics. The wedge-shaped arms of the cathode layer 2 have pointed outer ends on which the electric field can be concentrated to a maximum degree.

The insulative layer 31 is disposed on the surface of the base electrode 30 and the control electrode 4 is disposed on the insulative layer 3 which is in turn disposed on the insulative layer 31. Thus, the dielectric strength between the cathode layer 2 and the control electrode 4 is increased to facilitate concentration of the electric field on the edges of the cathode layer 2. Consequently, the electron emission efficiency of the electron emission device is high, and so is the reliability of the electron emission device. The cathode electrode 4 is positioned at the same height as or higher than the upper surface of the cathode layer 2, so that electrons emitted from the edge 2*a* of the cathode layer 2 are prevented from spreading. The emitted electron beam is therefore of high quality.

The matrix electron emission source incorporating the electron emission device according to the fifteenth embodiment is capable of uniformly emitting many electrons.

According to the process of manufacturing the electron emission device of the fourteenth embodiment, the base electrode is deposited by sputtering or the like, the surface of the base electrode is anodized or thermally oxidized, the cathode layer is deposited by sputtering, etching, or the like, and the insulative layer and the control electrode on the insulative layer on the surface of the base electrode are deposited by sputtering or the like. Since electrons are emitted from the edge of the cathode layer, the cathode is not required to be formed as a needle point, and hence can be manufactured with ease. The control electrode is shaped complementarily to the cathode layer which has been formed to a certain shape. Therefore, the cathode layer and the control layer are positionally related to each other with high accuracy. The electron emission device thus fabricated has a high electron emission efficiency, and provides a high dielectric voltage between the cathode layer and the control electrode. The electron emission device therefore can emit electrodes highly reliably. The electron emission device can also be manufactured easily with a high yield. Furthermore, the electron emission device can emit a high-quality convergent electron beam which is prevented from spreading apart.

Although certain preferred embodiments have been shown and described, it should be understood that many changes and modifications may be made therein without departing from the scope of the appended claims.

What is claimed is:

1. An electron field emission device comprising:

an insulative substrate;

a cathode layer disposed on said insulative substrate, said cathode layer having an edge on an upper surface thereof remote from said insulative substrate and a transverse cross-sectional shape taken across said edge, said transverse cross-sectional shape having a rectangular shape;

a first insulative layer disposed on said insulative substrate and arranged on at least one side of said cathode layer; and a control electrode disposed on said first insulative layer higher than said cathode layer, for drawing electrons from said edge of the cathode layer in a direction upwardly away from said insulative substrate, said control electrode being spaced and electrically insulated from said cathode layer.

2. An electron field emission device according to claim 1, wherein said first insulative layer is as thick as or thicker than said cathode layer.

3. An electron field emission device according to claim 1, wherein said cathode layer is formed of a plurality of parallel cathode layers spaced apart at a first predetermined pitch, sand said control electrode is formed of a plurality of parallel control electrodes spaced apart at a second predetermined pitch and crossing said cathode layers with an overpass at regular angles.

4. An electron field emission device according to claim 3, wherein said cathode layers and said control electrodes jointly provide a plurality of electron emission areas being of a zigzag shape.

5. An electron field emission device according to claims 1, wherein said cathode layer has a wedge-shaped portion having a progressively varying width in a plane parallel to said insulative substrate.

6. An electron field emission device according to claim 5, further including a base electrode disposed between said insulative substrate and said cathode layer to dispose said cathode layer on said base electrode, said cathode layer being supplied an electric current from said base electrode.

7. An electron field emission device according to claim 6, further including a second insulative layer disposed on at least a surface of said base electrode which is free of said cathode layer thereon to arrange said second insulative layer between said base electrode and said first insulative layer, said first insulative layer being disposed on said second insulative layer.

8. An electron field emission device according to claim 5, 6, or 7, wherein said first insulative layer is as thick as or thicker than said cathode layer.

9. An electron field emission device according to claim 6 or 7, in which said base electrode is formed of a plurality of parallel striped base electrodes being spaced apart at a first predetermined pitch, and a plurality of parallel control electrodes spaced apart at a second predetermined pitch and crossing said base electrodes with an overpass at regular angles, whereby said cathode layer is positioned on each of said parallel striped base electrodes and said parallel striped base electrodes and said parallel control electrodes jointly provide a matrix construction.

10. An electron field emission device comprising:

at least a pair of cathode layers, each of said cathode layers having an edge, said edges of said cathode layers being in a confronting relationship; and a control electrode spaced and electrically insulated from said cathode layers, for drawing electrons from said edges of the cathode layers, said electron emission device further comprising an insulative substrate, each of said cathode layers being disposed on said insulative substrate, and an insulative layer disposed on said insulative substrate, said insulative layer spaced between said edges of said cathode layers, said control electrode being disposed on said insulative layer.

11. An electron field emission device according to claim 10, further including a conductive layer extending through said insulative layer and electrically connected to said control electrode on said insulative layer.

12. An electron field emission device according to claim 10 or 11, wherein said control electrode has a bottom surface as high as or higher than a surface of said cathode layer remote from said insulative substrate.

13. An electron field emission device comprising:

a cathode layer having an edge;

a control electrode spaced and electrically insulated from said cathode layer, for drawing electrons from said edge of the cathode layer, said electron emission device further comprising an insulative substrate, said cathode layer being disposed on said insulative substrate, said control electrode comprising first and second control electrodes, a first insulative layer disposed on said cathode layer, said fist control electrode being disposed on said first insulative layer, and a second insulative layer disposed on said insulative substrate, said second control electrode being disposed on said second insulative layer wherein said second control electrode is spaced outwardly from said cathode layer, said first insulative layer, and said first control electrode, said first and second control electrodes being electrically connected to each other.

14. An electron field emission device according to claim 13, further including a third insulative layer disposed on portions of said cathode layer and said insulative substrate, and an electric connector disposed on said third insulative layer, said first and second control electrodes being electrically connected to each other by said electric connector.

15. An electron field emission device according to claim 13, further including a hole penetrating the inside of said cathode layer, a periphery of said hole being buried by said first insulative layer, a third insulative layer disposed on said insulative substrate to arrange both said second insulative layer, and an electric connector extending through said first insulative layer, said hole surrounded by said first insulative layer, said third insulative layer, and said second insulative layer, said first and second control electrodes being electrically connected to each other by said electric connector.

16. An electron field emission device according to claim 13, 14, or 15, further including a fourth insulative layer disposed on said second control electrode, and a third control electrode disposed on said fourth insulative layer.

* * * * *